US009206005B2

(12) United States Patent
Fujita et al.

(10) Patent No.: US 9,206,005 B2
(45) Date of Patent: Dec. 8, 2015

(54) SHEET CONVEYING APPARATUS AND IMAGE FORMING APPARATUS

(71) Applicant: CANON KABUSHIKI KAISHA, Tokyo (JP)

(72) Inventors: Takashi Fujita, Kashiwa (JP); So Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/483,496

(22) Filed: Sep. 11, 2014

(65) Prior Publication Data

US 2015/0108709 A1 Apr. 23, 2015

(30) Foreign Application Priority Data

Oct. 17, 2013 (JP) ..... 2013-215928

(51) Int. Cl.

| | |
|---|---|
| ***B65H 5/06*** | (2006.01) |
| ***B65H 3/06*** | (2006.01) |
| ***B65H 9/00*** | (2006.01) |
| ***B65H 7/06*** | (2006.01) |

(52) U.S. Cl.

CPC ..... *B65H 5/068* (2013.01); *B65H 3/06* (2013.01); *B65H 5/062* (2013.01); *B65H 7/06* (2013.01); *B65H 9/002* (2013.01); *B65H 2404/1341* (2013.01)

(58) Field of Classification Search

CPC ..... B65H 5/062; B65H 2404/1314; B65H 2404/1371; B65H 2404/1422; B65H 2404/143; B65H 2404/144; B65H 2404/1341; B65H 2404/1351; B65H 2404/117

USPC ..... 271/273, 274, 252

See application file for complete search history.

(56) References Cited

U.S. PATENT DOCUMENTS

| | | | | |
|---|---|---|---|---|
| 4,768,050 | A * | 8/1988 | Beery | 396/583 |
| 4,780,746 | A * | 10/1988 | Naramore et al. | 271/274 |
| 6,135,446 | A * | 10/2000 | Thiemann et al. | 271/228 |
| 6,409,043 | B1 | 6/2002 | Fujita et al. | |
| 7,306,221 | B2 | 12/2007 | Agata | |
| 7,422,209 | B2 * | 9/2008 | Hashimoto | 271/228 |
| 7,748,697 | B2 | 7/2010 | Fujita et al. | |
| 8,240,665 | B2 | 8/2012 | Fujita | |

(Continued)

FOREIGN PATENT DOCUMENTS

| | | | |
|---|---|---|---|
| JP | 06-298435 | A | 10/1994 |
| JP | 07-72707 | A | 3/1995 |
| JP | 08-216364 | A | 8/1996 |
| JP | 3290766 | A | 6/2002 |

(Continued)

*Primary Examiner* — Michael McCullough

(74) *Attorney, Agent, or Firm* — Fitzpatrick, Cella, Harper & Scinto

(57) ABSTRACT

A sheet conveying apparatus has a conveying rotating member, a follower rotating member which is disposed to face the conveying rotating member, a support member which passes through a hollow portion of the follower rotating member and supports the follower rotating member, a pressure portion which biases the support member toward the conveying rotating member so that the follower rotating member comes into contact with the conveying rotating member a first bearing portion which is disposed between an outer peripheral surface of the support member and an inner peripheral surface of the follower rotating member and rotatable supports the follower rotating member with respect to the support member, and a second bearing portion which movably supports the support member and has a slide friction coefficient higher than that of the bearing portion.

17 Claims, 22 Drawing Sheets

(56) References Cited

U.S. PATENT DOCUMENTS

| | | | |
|---|---|---|---|
| 8,699,936 | B2 | 4/2014 | Fujita |
| 2005/0242493 | A1 | 11/2005 | Agata |

FOREIGN PATENT DOCUMENTS

| | | | |
|---|---|---|---|
| JP | 2005-314045 | A | 11/2005 |
| JP | 4035514 | B2 | 1/2008 |

* cited by examiner

SHEET CONVEYING APPARATUS AND IMAGE FORMING APPARATUS

BACKGROUND OF THE INVENTION

1. Field of the Invention

The present invention relates to a sheet conveying apparatus which conveys a sheet and an image forming apparatus which is provided with the sheet conveying apparatus.

2. Description of the Related Art

Conventionally, a sheet conveying apparatus which conveys a sheet to an image forming portion is provided in an image forming apparatus such as a copying machine, a printer, and a facsimile machine. As such an image forming apparatus of an electrophotographic system, there is provided an apparatus suitable for a light printing market (Print On Demand (POD)) in which a small number of printing times are performed while keeping a merit in that no plate is necessary compared to an offset printing machine. However, in order to be credited for such a light printing market, high productivity, high durability, high quality, and processibility of various types of sheets are required.

A sheet is conveyed toward an image forming portion by the sheet conveying apparatus of the image forming apparatus. At this time, when skew feeding of the sheet or a deviation from a position (a lateral registration position) in a width direction perpendicular to the sheet conveying direction occurs, an image is formed in a state that the imaging position is deviated.

Therefore, the sheet conveying apparatus is provided with a skew feeding correction portion which corrects the skew feeding of the sheet and adjusts the lateral registration position on the upstream side in the sheet conveying direction of the image forming portion. As an example of such a skew feeding correction portion, U.S. Patent Application Publication No. 2005/242493 A1 proposes a configuration in which the positional deviation at the side end of a conveying sheet is corrected on the basis of a side registration.

As an example of processibility of various types of sheets, thick sheet processing is exemplified. Generally, a printer or a multifunction peripheral processes a sheet as heavy as about a basis weight of 250 g/m$^2$. When a sheet having a basis weight of 300 g/m$^2$ or more is processed, the apparatus can also be applied to markets such as POP (Point Of Purchase advertising) advertisement printing and package printing.

Since stiffness of the sheet is increased with respect to the basis weight (thickness) in an accelerating manner, specifically, when the sheet is conveyed in a bent state, a conveying force required for the bent portion is also significantly increased. Even in U.S. Patent Application Publication No. 2005/242493 A1, since the sheet is conveyed in an upwardly bent state over a range from a registration roller to a secondary transfer portion, the conveying force is necessarily increased.

Specifically, in order to obtain sheet conveying accuracy of the registration roller with respect to the conveying direction, a driving roller may be made of a material such as metal which easily achieves accuracy of an outer diameter and a driven roller may be made of rubber. However, since the metal roller has a low friction coefficient, a large nipping force is necessary for obtaining the conveying force. Further, in order to avoid a conveying error caused by rippling in a direction perpendicular to the conveying direction of the sheet which is not yet transferred, the registration roller may be made longer than the width of the sheet and configured to nip the whole range of the sheet in the width direction.

FIGS. 20 and 21 are diagrams illustrating a pair of registration rollers 5 of a comparative example when viewed from the sheet conveying direction. In the drawings, a bending state when a follower roller 2 is pressurized in order to obtain a nipping force of the pair of registration rollers 5 is illustrated. The follower roller 2 is provided to face a driving roller 1 which is rotatably driven, and bearing members 3 are disposed in both end portions of the respective rollers 1 and 2 such that the respective rollers 1 and 2 are freely rotated.

The bearing member 3 provided in the driving roller 1 is supported to an apparatus frame (not illustrated) by a fulcrum A of FIG. 20, and the bearing member 3 provided in the follower roller 2 is pressurized toward the driving roller 1 in a direction of arrow F of FIG. 20. In this case, the respective rollers 1 and 2 each receive rotational moments in directions of arrows R1 and R2 of FIG. 20 about points P on the outer side from end portions of a sheet 4*a* in the width direction, and thus are bent in a reverse direction to each other.

Therefore, a large urging force is applied in a direction of arrow F of FIG. 20 in order to secure the conveying force of the sheet 4*a* made of thick paper. In this state, when a thin and narrow sheet 4*b* is conveyed as illustrated in FIG. 21, the nipping force for the sheet 4*b* becomes insufficient, and thus a conveyance fail may occur.

The invention has been made to solve the above problems, and it is desirable to provide a sheet conveying apparatus which can secure a conveying force with respect to various types of sheets without raising an urging force to pressurize a follower rotating member toward a conveying rotating member.

SUMMARY OF THE INVENTION

As a representative configuration of a sheet conveying apparatus according to the invention in order to achieve the above object, there is provided a sheet conveying apparatus having a conveying rotating member which is rotatably driven by a driving portion and conveys a sheet, a cylindrical follower rotating member which is disposed to face the conveying rotating member, a support member which passes through a hollow portion of the follower rotating member and supports the follower rotating member, a pressure portion which biases the support member toward the conveying rotating member so that the follower rotating member comes into contact with the conveying rotating member, a first bearing portion which is disposed between an outer peripheral surface of the support member and an inner peripheral surface of the follower rotating member and rotatably supports the follower rotating member with respect to the support member, and a second bearing portion which movably supports the support member and has a slide friction coefficient higher than that of the bearing portion.

Further features of the present invention will become apparent from the following description of exemplary embodiments with reference to the attached drawings.

DESCRIPTION OF THE EMBODIMENTS

An embodiment of a sheet conveying apparatus and an image forming apparatus which includes the sheet conveying apparatus according to the invention will be described in detail with reference to the drawings.

First Embodiment

Image Forming Apparatus

Figure 1:
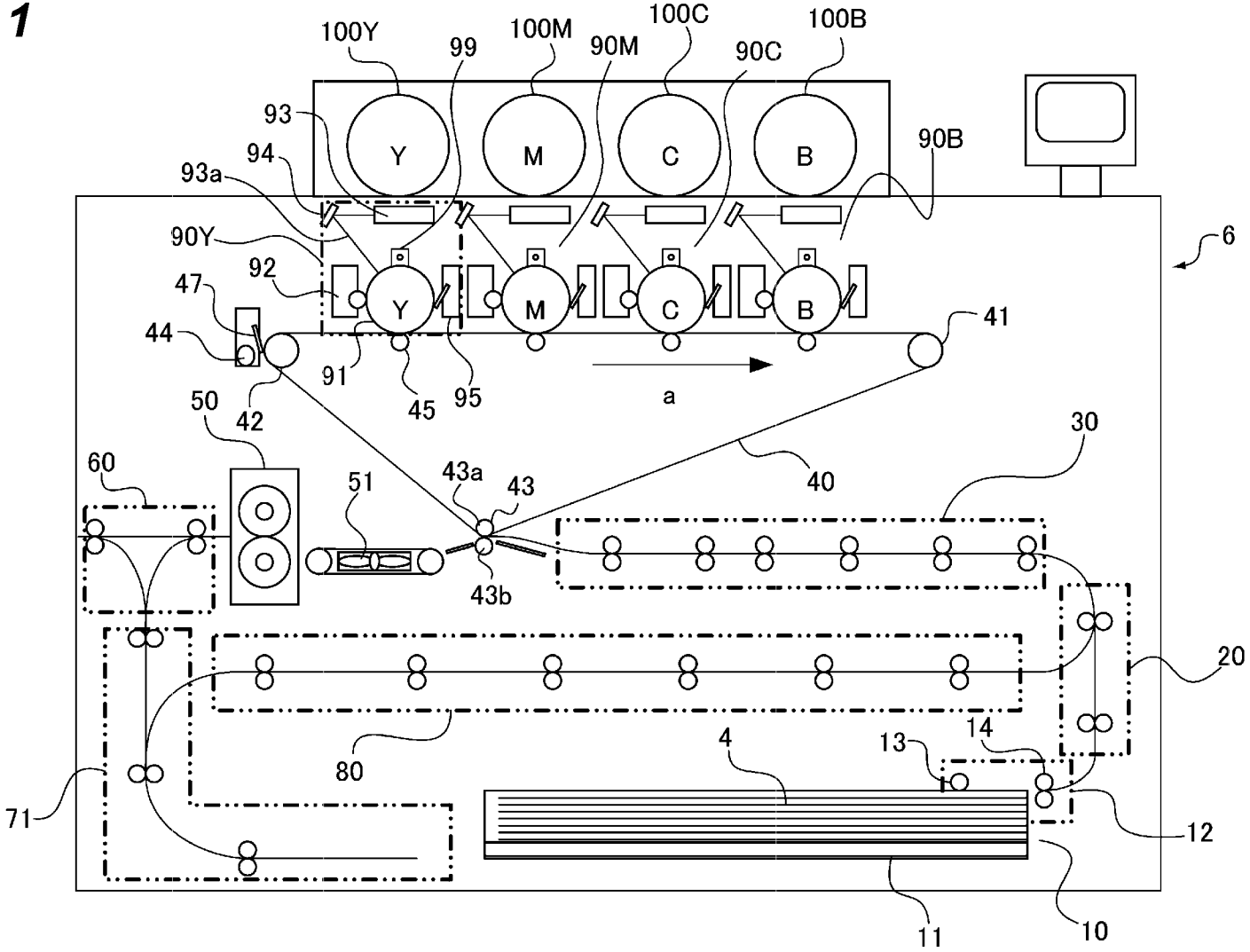
FIG. 1 is a cross-sectional view for describing a configuration of an image forming apparatus which includes a sheet conveying apparatus according to the invention.

First, the configuration of a first embodiment of a sheet conveying apparatus and an image forming apparatus which includes the sheet conveying apparatus according to the invention will be described using FIGS. 1 to 15. FIG. 1 is a cross-sectional view schematically illustrating an image forming apparatus 6 of the embodiment. The sheet 4 serving as a recording material is stacked on a lift-up apparatus 11 which is provided in a sheet feeding apparatus 10 and contained thereon. The sheet 4 is fed from a sheet feeding portion 12 which includes a feeding roller 13 and a separating/conveying roller 14 in synchronization with a timing point when an image is formed by an image forming portion 90 serving as an image forming portion which forms a toner image on the sheet 4.

The sheet feeding portion 12 picks up the uppermost sheet 4 stacked on the lift-up apparatus 11 by the feeding roller 13, separates the sheets one by one using the separating/conveying roller 14, and feeds the sheet 4. The sheet 4 sent out of the sheet feeding portion 12 passes through a conveying unit 20 forming a conveying path and is conveyed to a registration unit 30 serving as the sheet conveying apparatus. After skew feeding correction and timing correction of the sheet 4 is performed in the registration unit 30, the sheet is sent to a secondary transfer portion 43 serving as a nip portion between an intermediate transfer belt 40 and a secondary transfer roller 43*b*.

The secondary transfer portion 43 is formed by a nip portion between a secondary transfer inner-roller 43*a* and the secondary transfer roller 43*b* with the intermediate transfer belt 40 interposed therebetween. A toner image formed on an outer peripheral surface of the intermediate transfer belt 40 is transferred onto the sheet 4 by applying a predetermined urging force and a secondary transfer bias voltage to the sheet 4 passing through the secondary transfer portion 43.

Regarding a conveying process of the sheet 4 up to the secondary transfer portion 43, a process of forming the toner image sent up to the secondary transfer portion 43 at a predetermined timing point will be described. Each of image forming portions 90Y, 90M, 90C, and 90B of yellow Y, magenta M, cyan C, and black B is generally configured to include a photosensitive drum 91 serving as an image bearing member, an exposure apparatus 93, a developing apparatus 92, a primary transfer unit 45, a cleaning apparatus 95, and the like. Further, for the convenience of explanation, the image forming portion 90 will be used as a representative of the respective image forming portions 90Y, 90M, 90C, and 90B.

The surface of the photosensitive drum 91 which rotates in a counterclockwise direction of FIG. 1 is uniformly charged by a charging apparatus 99. Then, a laser beam 93*a* is output from the exposure apparatus 93 based on image information, and reflected on a mirror 94 to irradiate the surface of the photosensitive drum 91, so that an electrostatic latent image is formed on the surface of the photosensitive drum 91.

The developing apparatus 92 supplies toner to the electrostatic latent image formed on the surface of the photosensitive drum 91 and forms a toner image. Then, the primary transfer unit 45 disposed to face the photosensitive drum 91 with the intermediate transfer belt 40 interposed therebetween applies a predetermined urging force and a primary transfer bias voltage so as to transfer the toner image onto the outer peripheral surface of the intermediate transfer belt 40. Then, residual transfer toner slightly left on the surface of the photosensitive drum 91 is recovered by the cleaning apparatus 95 and preserved for the next image forming process.

Toner bottles 100Y, 100M, 100C, and 100B corresponding to the image forming portions 90 of the respective colors are sequentially disposed, and frequently replenish the toner into developer containers of the developing apparatuses 92 according to a toner amount contained in the developer containers of the developing apparatuses 92 of the respective colors. Further, in the embodiment, the description is made using four-color toners, but the color of the toner is not limited to the four colors. Further, also the arrangement of colors is not limited to that illustrated in FIG. 1.

<Intermediate Transfer Belt>

Next, the configuration of the intermediate transfer belt 40 will be described. The intermediate transfer belt 40 is rotatably suspended on a driving roller 42, a tension roller 41, and the secondary transfer inner-roller 43*a*, and driven in a direction of arrow a of FIG. 1. The image forming processes performed by the image forming portions 90 of the respective colors in parallel are implemented at a timing point when a toner image is overlapped with a toner image on the upstream side which has been primarily transferred on the outer peripheral surface of the intermediate transfer belt 40 from the surfaces of the photosensitive drums 91 of the respective colors. As a result, a full-color toner image is finally formed on the outer peripheral surface of the intermediate transfer belt 40 and conveyed to the secondary transfer portion 43.

The full-color toner image is secondarily transferred onto the surface of the sheet 4 in the secondary transfer portion 43 through the conveying process of the sheet 4 by the sheet conveying apparatus and the image forming process by the image forming portion 90 described above. The sheet 4 with the toner image transferred thereon is conveyed to a fixing apparatus 50 by a conveying belt 51. The fixing apparatus 50 applies the predetermined urging force caused by a pair of facing rollers or facing belts and heat generated by a heat source such as a halogen heater onto the toner image to melt and fix the toner image on the surface of the sheet 4.

<Duplex Conveying Operation>

Next, a conveying operation when the toner image is formed on both surfaces of the sheet 4 will be described. The sheet 4 sent from the fixing apparatus 50 to a reverse conveying apparatus 71 is subjected to a switchback conveying operation to exchange the leading end and the trailing end of the sheet 4 and then conveyed to a duplex conveying apparatus 80. Then, the sheet is joined to a refeeding path provided in the conveying unit 20 from the duplex conveying apparatus 80 in synchronization with a timing point of the following sheet 4 coming to be transferred from the sheet feeding apparatus 10, and similarly sent to the secondary transfer portion 43. Since the image forming process is the same as that of the front face of the sheet 4, the redundant description will not be repeated.

<Registration Unit>

Figure 2:
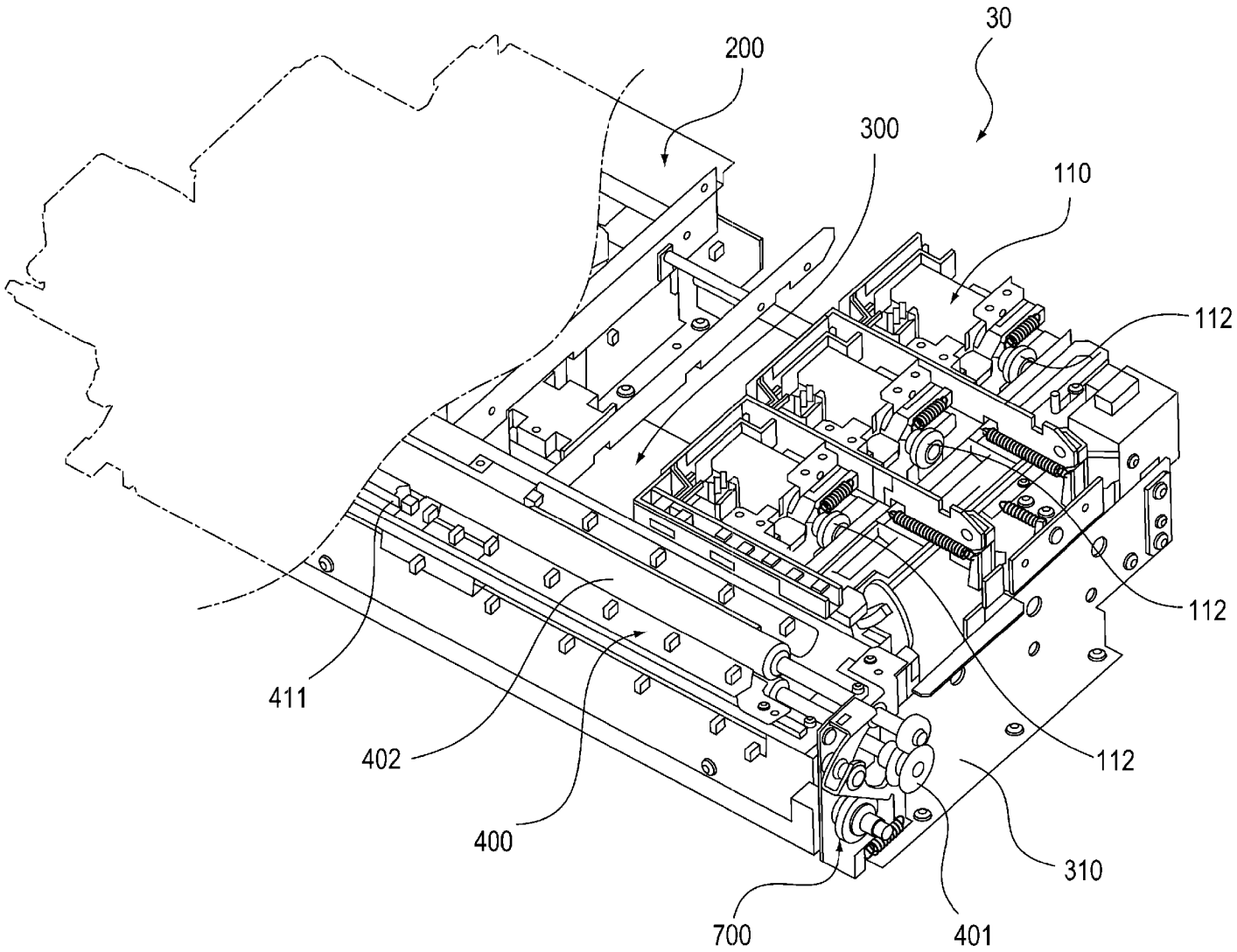
FIG. 2 is a perspective view for describing a configuration of a registration unit of a first embodiment of the sheet conveying apparatus according to the invention.
Figure 3:
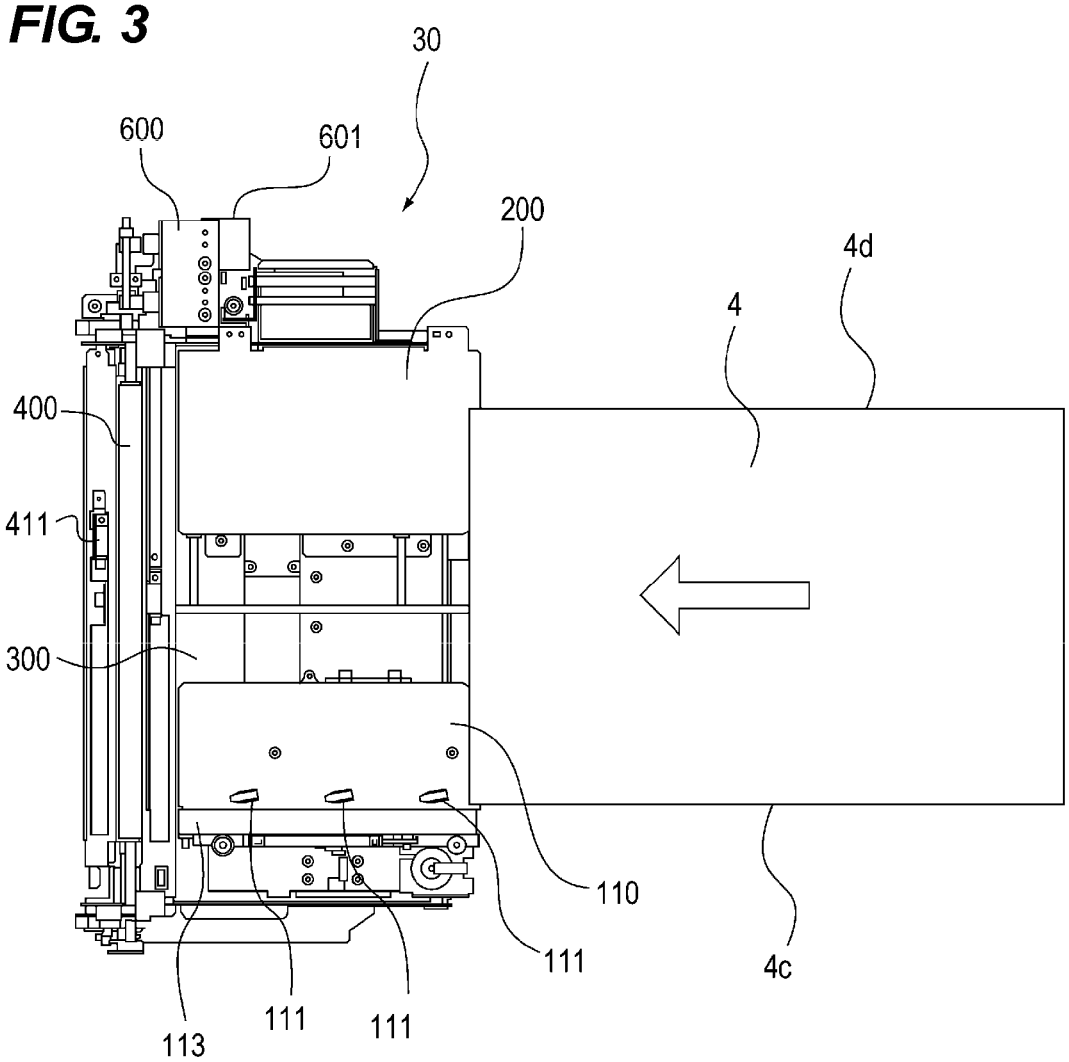
FIG. 3 is a plan view for describing a configuration of the registration unit of the first embodiment.

The configuration of the registration unit 30 will be described using FIGS. 2 to 4. FIG. 2 is a perspective view for describing a configuration of the registration unit 30. FIG. 3 is a plan view for describing the configuration of the registration unit 30. In FIGS. 2 and 3, the registration unit 30 includes a skew-conveying roller guide portion 110 to form a conveying path through which the sheet 4 is conveyed while a side end portion (the side end portion illustrated on the lower side of FIG. 3) 4*c* of the sheet 4 is supported. Further, a fixed guide portion 200 which supports the other side end portion (the side end portion illustrated on the upper side of FIG. 3) 4*d* of the sheet 4 is provided.

The skew-conveying roller guide portion 110 is configured to allow the sheet 4 to move to a position in a width direction (a direction perpendicular to the sheet conveying direction; a vertical direction of FIG. 3) by a skew-conveying guide moving portion 300 serving as a positioning portion.

On the downstream side in the sheet conveying direction of the skew-conveying roller guide portion 110 and the fixed guide portion 200, a pair of registration rollers 400 and a registration roller driving portion 500 are provided. Further, there are provided a registration roller slide portion 600 which is a slide portion moving reciprocally in the width direction (an axial direction of the pair of registration rollers 400) of the sheet 4, and a registration roller pressure releasing portion 700 which is a contact/separation portion making the pair of registration rollers 400 come into contact or be separated. On the downstream side in the sheet conveying direction of the skew-conveying roller guide portion 110 (the left side of FIG. 3), a sheet detecting sensor 411 which is a sheet detecting portion is provided.

<Skew-Conveying Roller Guide Portion>

FIG. 3 is a plan view for describing the registration unit 30, in which the upper guide portion of the skew-conveying roller guide portion 110 and the fixed guide portion 200 is not illustrated. As illustrated in FIG. 3, there is provided a skew-conveying roller 111 of which the downstream side is inclined toward an abutting plate 113 with respect to the conveying direction (the horizontal direction of FIG. 3) of the sheet 4. On the other hand, as illustrated in FIG. 2, a roller 112 is provided to face the skew-conveying roller 111 illustrated in FIG. 3 and axially supported thereto so as to be freely rotated. The skew-conveying roller 111 is rotated by a rotation driving force transferred from a driving portion such as a motor (not illustrated).

Figure 11A:
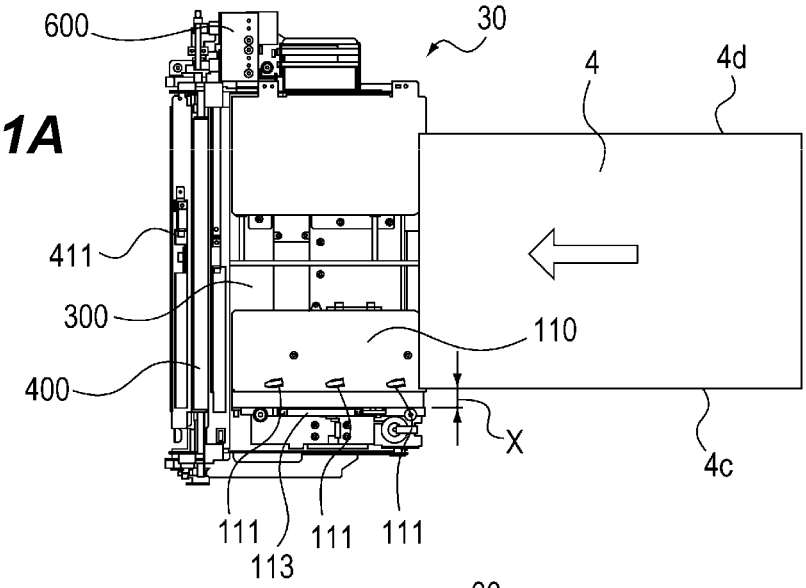
FIG. 11A is a plan view for describing behavior of a sheet in the registration unit of the first embodiment.
Figure 11B:
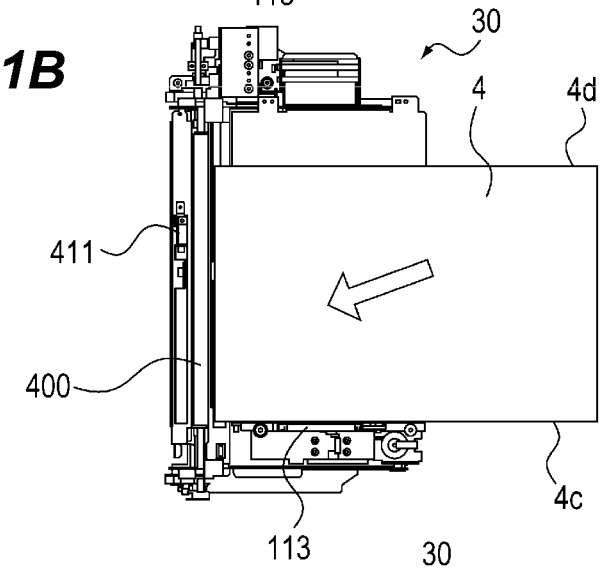
FIG. 11B is a plan view for describing behavior of a sheet in the registration unit of the first embodiment.

When the sheet 4 comes to be sent from the conveying unit 20 illustrated in FIG. 1 to the registration unit 30, the sheet 4 is nipped and conveyed by the skew-conveying roller 111 illustrated in FIG. 3 and the roller 112 illustrated in FIG. 2. At this time, as illustrated in FIG. 11B, the sheet 4 is conveyed while the sheet is pushed toward the abutting plate 113 illustrated in FIG. 3 by the operation of the skew-conveying roller 111 to press a side end portion 4*c* of the sheet 4 to the abutting plate 113 and slides in contact therewith. Therefore, the sheet 4 in the width direction (the vertical direction of FIG. 3) is positioned to the abutting plate 113.

<Fixed Guide Portion>

The fixed guide portion 200 illustrated in FIG. 3 supports a side end portion 4*d* of the sheet 4 opposite to the abutting plate 113 when the sheet 4 is conveyed obliquely toward the abutting plate 113 by the skew-conveying roller 111.

<Skew-Conveying Guide Moving Portion>

The skew-conveying guide moving portion 300 illustrated in FIG. 3 integrally moves the skew-conveying roller guide portion 110 including the skew-conveying roller 111 and the abutting plate 113 in a direction (the vertical direction of FIG. 3) perpendicular to the conveying direction of the sheet 4. Therefore, the skew-conveying roller guide portion 110 including the skew-conveying roller 111 and the abutting plate 113 can move according to length in the width direction (the vertical direction of FIG. 3) of the sheet 4, and thus appropriately positioned in accordance with a size of the sheet 4.

<Pair of Registration Rollers and Contact/Separation Portion>

Figure 4:
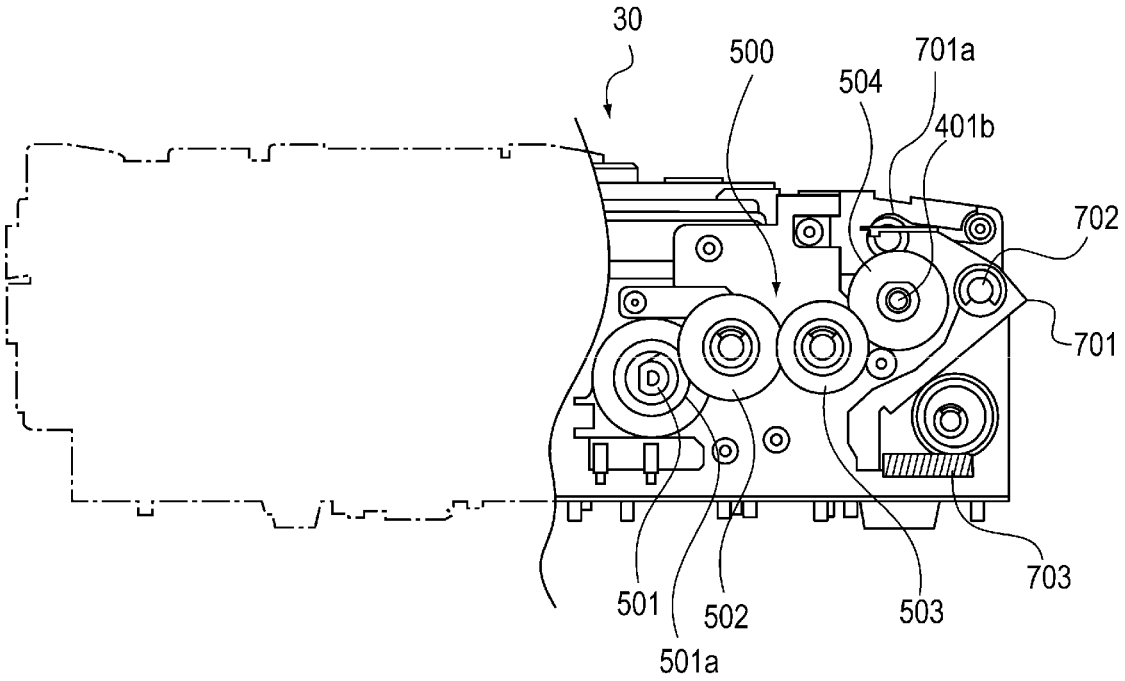
FIG. 4 is a side view for describing a configuration of the registration unit of the first embodiment.

FIGS. 4 to 7 are diagrams illustrating the configurations of the pair of registration rollers 400 and the registration roller pressure releasing portion 700. In FIG. 4, as illustrated in FIG. 12, a registration follower roller 402 serving as a cylindrical follower rotating member is disposed to face a registration driving roller 401 serving as a conveying rotating member which is rotatably driven by a registration roller driving motor 501 serving as a driving portion to convey the sheet 4.

Figure 5:
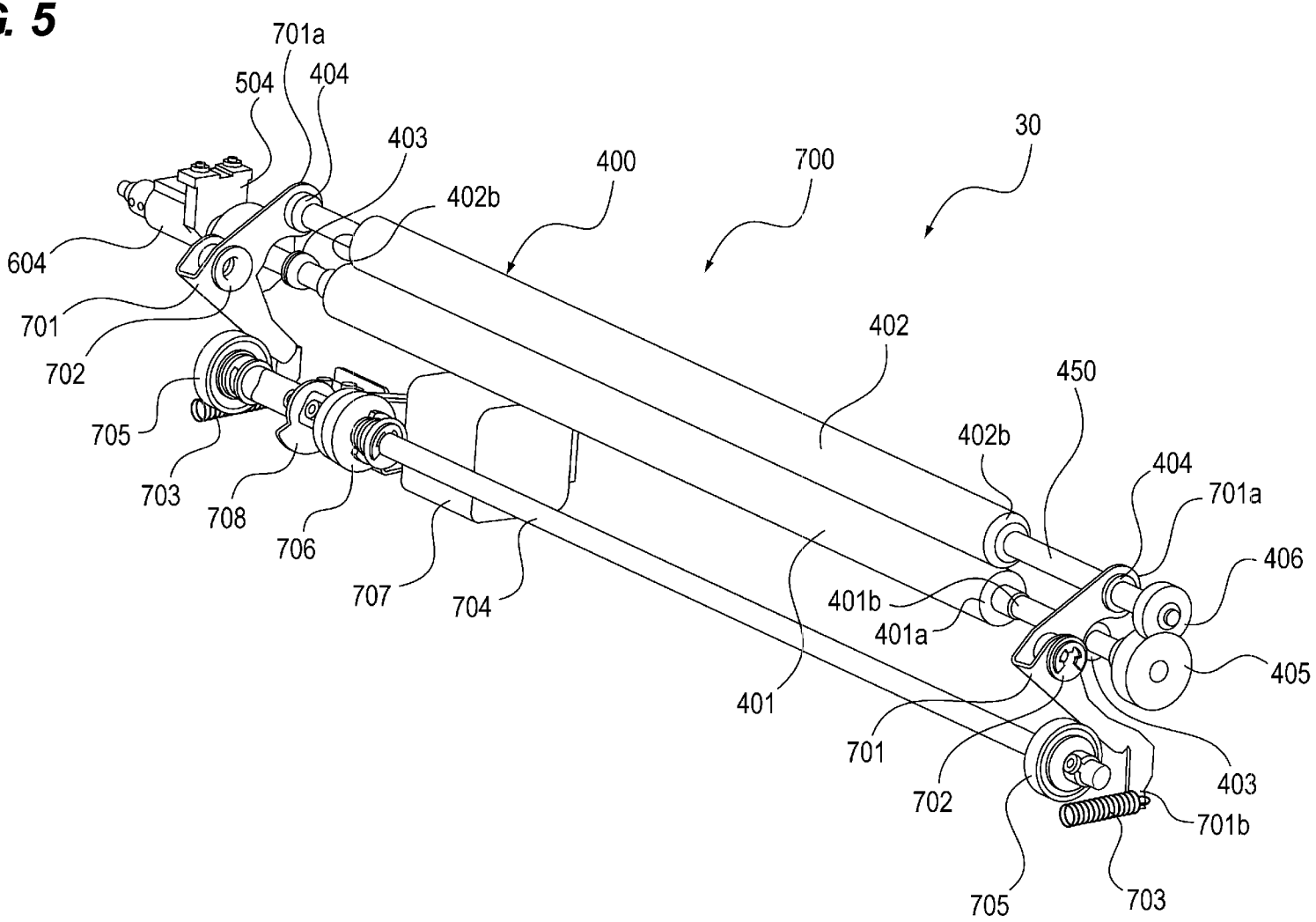
FIG. 5 is a perspective view for describing a configuration of a contact/separation portion of the registration unit of the first embodiment.
Figure 12:
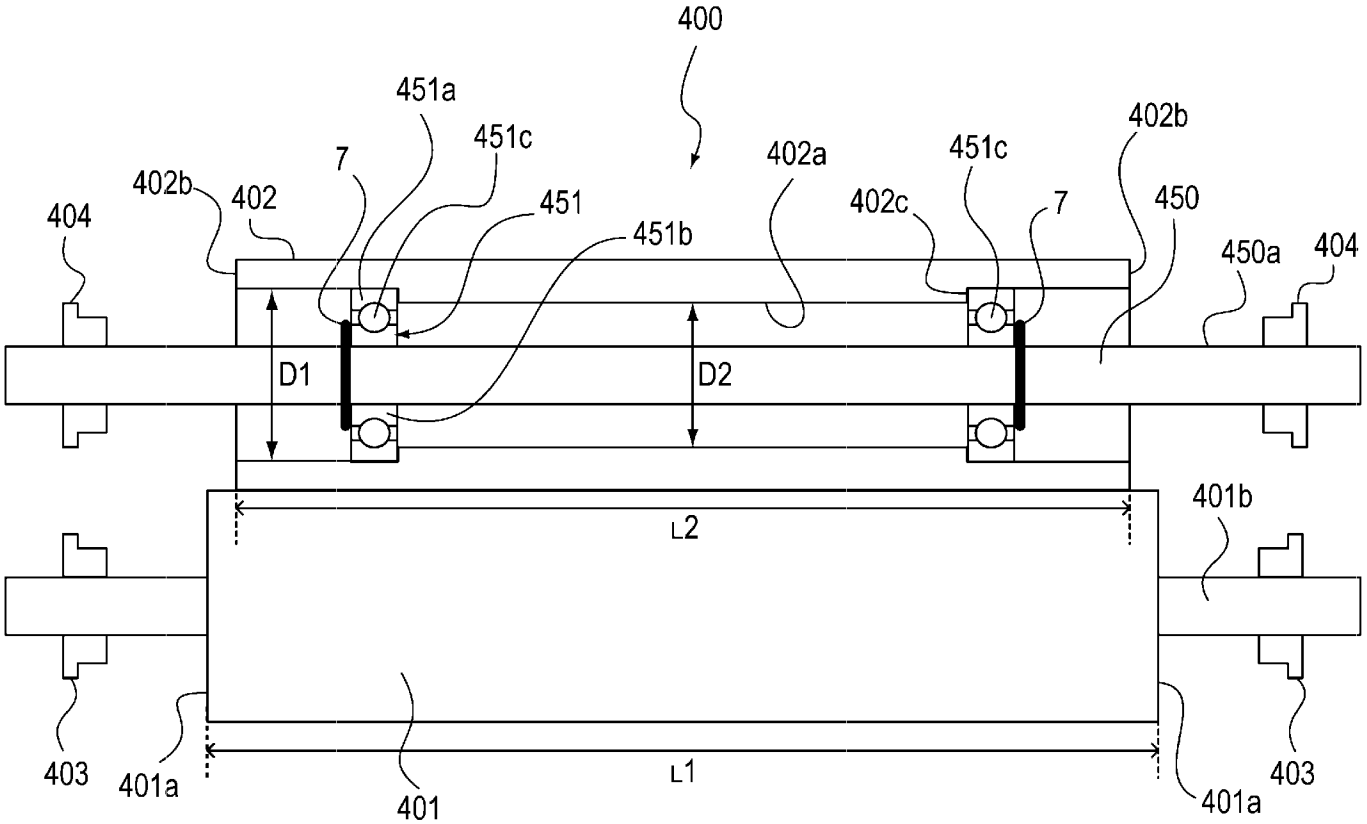
FIG. 12 is a cross-sectional view for describing a configuration of the pair of registration rollers which includes the follower rotating member and the conveying rotating member of the first embodiment.

As illustrated in FIG. 12, a shaft member 450 serving as a support member which is disposed to be separated from an inner peripheral surface 402*a* of the registration follower roller 402 passes through a hollow inner portion of the registration follower roller 402. As illustrated in FIG. 5, the registration roller pressure releasing portion 700 is provided with a pressure spring 703 formed by a coil spring which serves as a pressure portion to pressurize the outer portion the registration follower roller 402 in the shaft member 450 toward the registration driving roller 401.

As illustrated in FIG. 5, the shaft member 450 is axially supported by a sliding bearing member 404 to be freely rotated. The sliding bearing member 404 serving as a second bearing member is provided in one end portion 701*a* of an L-shape pressure arm 701 which is provided to rotate about a pivot 702 with respect to an apparatus frame. The sliding bearing member 404 supports the shaft member 450 to freely rotate, and disposed on the outer side in the axial direction from an end portion 402*b* in the axial direction of the registration follower roller 402 (the right and left sides of FIG. 12).

Figure 7A:
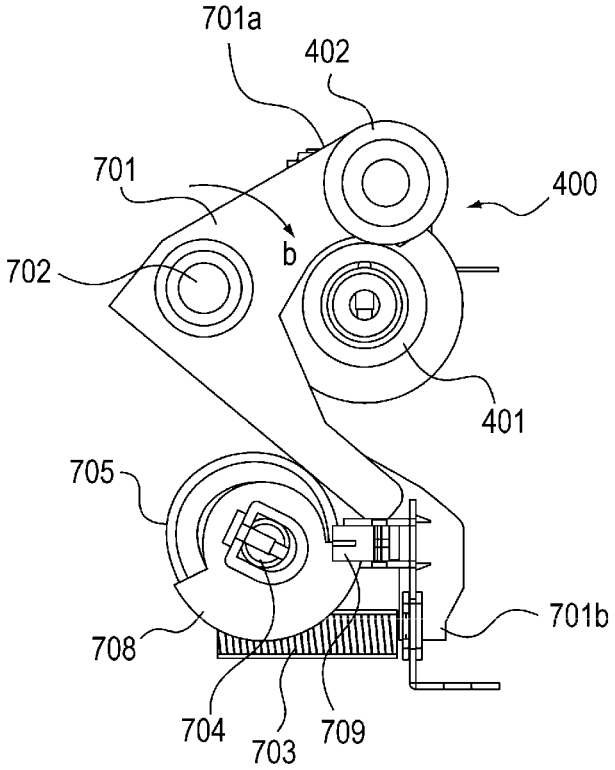
FIG. 7A is a side view for describing a state that a follower rotating member comes into contact with or is separated from a conveying rotating member by the contact/separation portion of the registration unit of the first embodiment.

The other end portion 701*b* of the pressure arm 701 is engaged with one end portion of the pressure spring 703, and the other end portion of the pressure spring 703 is engaged with the apparatus frame (not illustrated). As illustrated in FIG. 7A, the pressure arm 701 is rotated in a direction of arrow b of FIG. 7A about the pivot 702 by a tension force of the pressure spring 703, and the registration follower roller 402 is pressurized toward the registration driving roller 401 by the predetermined urging force.

As illustrated in FIG. 12, the registration driving roller 401 of the embodiment is formed of metal in a cylindrical shape, and configured to have outer diameters of both end portions 401*a* larger than that of the center portion in the axial direction conveying the sheet 4. As illustrated in FIGS. 2 and 12, a rotating shaft 401*b* of the registration driving roller 401 is rotatably supported by a bearing member 403 which is provided in apparatus frames 310 and 311.

As illustrated in FIG. 12, the registration follower roller 402 of the embodiment is formed of metal in a cylindrical shape, and the inner portion thereof is hollow. In the superficial surface of the registration follower roller 402, a rubber layer is coated. The shaft member 450 passing through the hollow inner portion of the registration follower roller 402 is slidably supported in the axial direction by the sliding bearing member 404 which is provided in one end portion 701*a* of the pressure arm 701.

As illustrated in FIG. 5, a disk portion 406 is provided to be fixed to one end portion of the shaft member 450 which supports the registration follower roller 402 to freely rotate. Further, a flange member 405 having an H shape in cross-sectional view corresponding to the disk portion 406 is provided to be fixed to the rotating shaft 401*b* of the registration driving roller 401. A recessed portion of the flange member 405 is configured to allow the disk portion 406 to be inserted.

On the other hand, as illustrated in FIG. 12, between an outer peripheral surface 450*a* of the shaft member 450 and the inner peripheral surface 402*a* of the registration follower roller 402, a bearing member 451 is provided on an inner side in the axial direction from the end portion 402*b* of the registration driving roller 401 in the axial direction. The bearing member 451 supports the registration follower roller 402 to freely rotate with respect to the shaft member 450. In the embodiment, the sliding bearing member 404 provided on the outer side in the axial direction from the bearing member 451 is configured to have a slide friction coefficient higher than that of the bearing member 451.

As illustrated in FIG. 12, a step portion 402*c* is formed in the inner peripheral surface 402*a* of the registration follower roller 402 such that an inner diameter of the inner peripheral surface on a side near the center portion in the axial direction smaller than that on a side near the end portion in the axial direction. The side face on an inner side of the bearing member 451 in the axial direction abuts on the step portion 402*c* and is engaged therewith, and the side face on an outer side of the bearing member 451 in the axial direction abuts on and is engaged with a stopper 7 which is engaged with the shaft member 450.

Therefore, the registration follower roller 402 is supported by the bearing member 451 to be freely rotated with respect to the shaft member 450, and when moving in the axial direction, the registration follower roller 402 and the shaft member 450 integrally move through the bearing member 451. The registration driving roller 401 and the rotating shaft 401*b* are fixed to each other, and integrally move when moving in the axial direction.

Therefore, as illustrated in FIG. 5, the registration driving roller 401 moves reciprocally in the axial direction integrally with the rotating shaft 401*b*. At this time, the flange member 405 fixed to the rotating shaft 401*b* is engaged with the disk portion 406 and pushes the disk portion in the axial direction. With this configuration, the registration follower roller 402 also slides in the axial direction in synchronization with the movement of the registration driving roller 401 integrally with the shaft member 450 to which the disk portion 406 is fixed.

<Registration Roller Driving Portion>

FIG. 4 is a side view for describing the registration unit 30. As illustrated in FIG. 4, the registration roller driving portion 500 is provided with the registration roller driving motor 501 which is fixed to the apparatus frame. A rotation driving force of the registration roller driving motor 501 is transferred to a gear 504, which is fixed to the rotating shaft 401*b* of the registration driving roller 401, through idler gears 502 and 503 which are meshed with a driving gear 501*a* fixed to the rotating shaft of the registration roller driving motor 501.

<Registration Roller Slide Portion>

Figure 6:
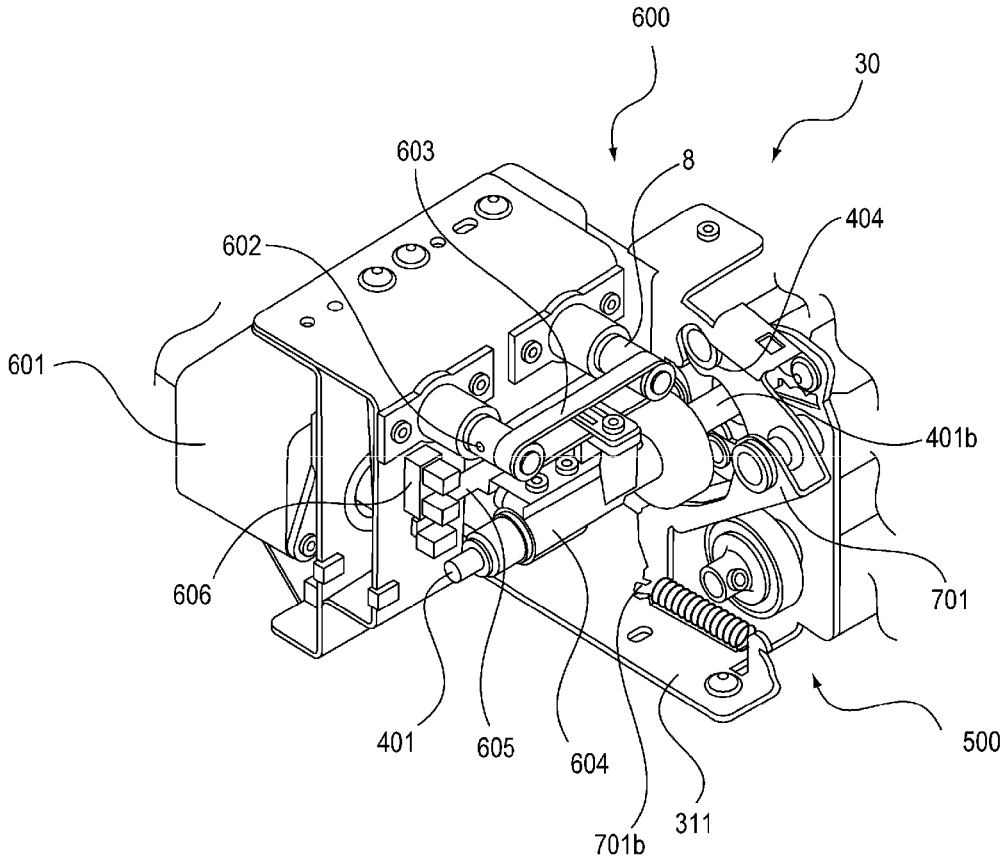
FIG. 6 is a perspective view for describing a configuration of a slide portion of the registration unit of the first embodiment.

FIG. 6 is a perspective view for describing a configuration of the registration roller slide portion 600 which is provided in the registration unit 30. A registration roller slide motor 601 illustrated in FIG. 6 rotatably drives a timing pulley 602 through a driving transmission portion (not illustrated). A timing belt 603 is suspended on the timing pulley 602 and a follower pulley 8. A holder 604 is fixed to a part of the timing belt 603.

When the registration roller slide motor 601 rotatably drives in a predetermined direction, the timing belt 603 moves through the timing pulley 602, and the holder 604 moves in the horizontal direction integrally with the timing belt 603. The holder 604 rotatably holds one end of the rotating shaft 401*b* of the registration driving roller 401, and the registration driving roller 401 makes a reciprocating motion in the axial direction integrally with the rotating shaft 401*b* held on the holder 604 according to the forward or reverse rotation of the registration roller slide motor 601.

The registration roller slide motor 601 of the embodiment is configured by a stepping motor, and a rotor of the registration roller slide motor 601 can be stopped at a predetermined angle by counting the number of pulses. A position of the registration driving roller 401 in the axial direction is determined by detecting a flag 605 which is provided in the holder 604 using a slide home position sensor 606.

<Registration Roller Pressure Releasing Portion>

As illustrated in FIG. 5, the sliding bearing members 404 support both end portions of the shaft member 450 of the registration follower roller 402 to be freely rotated or slid in the axial direction, and are fixed to a pair of pressure arms 701. The pressure arm 701 is rotated about the pivot 702 in a direction of arrow b of FIG. 7A by the tension force of the pressure spring 703. Therefore, the registration follower roller 402 is pressurized to the registration driving roller 401.

Figure 7B:
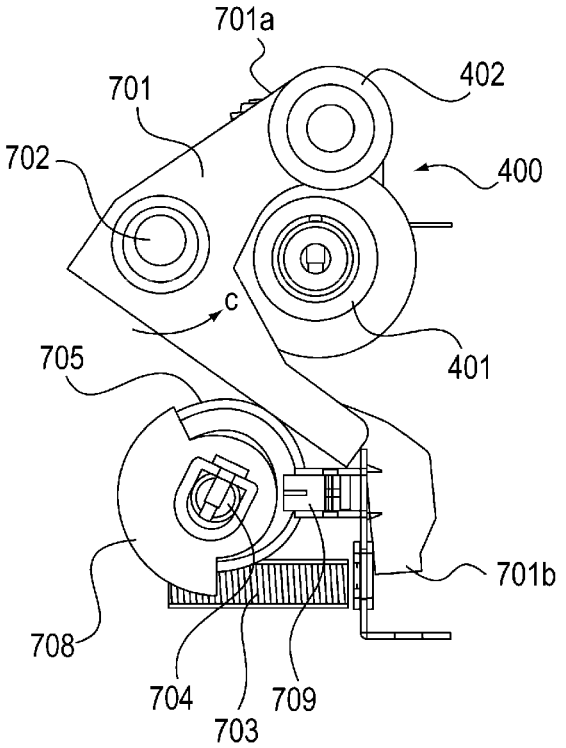
FIG. 7B is a side view for describing a state that a follower rotating member comes into contact with or is separated from a conveying rotating member by the contact/separation portion of the registration unit of the first embodiment.

As illustrated in FIGS. 5 and 7, a cam 705 which is fixed to a cam shaft 704 comes in contact with the pressure arm 701. A registration follower roller detachable motor 707 illustrated in FIG. 5 rotates a timing pulley 706 which is fixed to the cam shaft 704. Therefore, the cam shaft 704 rotates, and the cam 705 rotates integrally with the cam shaft 704. Then, the pressure arm 701 which comes in slidable contact with the cam 705 rotates about the pivot 702 in a direction of arrow c of FIG. 7B. Therefore, as illustrated in FIG. 7B, the registration follower roller 402 is separated from the registration driving roller 401.

The registration follower roller detachable motor 707 of the embodiment is configured by a stepping motor, and a rotor of the registration follower roller detachable motor 707 cam be stopped at a predetermined angle by counting the number of pulses.

FIG. 7A illustrates a state that the pressure arm 701 is rotated about the pivot 702 in a direction of arrow b of FIG. 7A by the tension force of the pressure spring 703 to make the registration follower roller 402 pressed to the registration driving roller 401. FIG. 7B illustrates a state that the registration follower roller detachable motor 707 illustrated in FIG. 5 is rotatably driven to rotate the cam 705. Then, the pressure arm 701 is rotated about the pivot 702 in a direction of arrow c of FIG. 7B against the tension force of the pressure spring 703 to separate the registration follower roller 402 from the registration driving roller 401.

An rotation angle of a disk flag 708 which is fixed to the cam shaft 704 is detected by a follower roller detachable home position sensor 709 to determine a stop position of the registration follower roller detachable motor 707.

In the embodiment, the registration follower roller 402 is controlled to come into contact with or be separated from the registration driving roller 401 using the registration roller pressure releasing portion 700 serving as the contact/separation portion. A central processing unit (CPU) 800 serving as a controller illustrated in FIG. 8 performs the following control. That is, the registration roller pressure releasing portion 700 is operated at a predetermined timing point during the rotation of the registration driving roller 401 to enable the registration follower roller 402 to stop at a predetermined position.

<Contact/Separation Operation and Sliding Operation of Pair of Registration Rollers>

Figure 8:
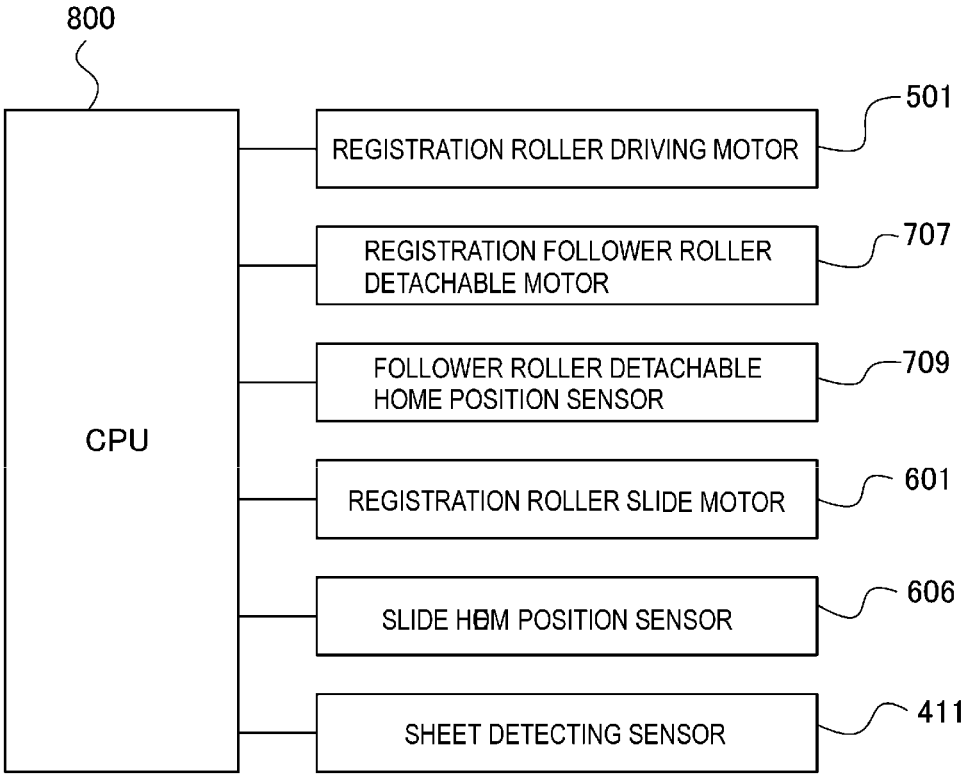
FIG. 8 is a block diagram illustrating a configuration of a control system of the first embodiment.

Next, behavior of the sheet 4 in the registration unit 30, a detaching operation of the pair of registration rollers 400, and a sliding operation of the pair of registration rollers 400 will be described using FIGS. 8 to 11. FIG. 8 is a block diagram of a control system, and the respective sensors and motors illustrated in FIG. 8 are controlled by the CPU 800 serving as the controller.

Figure 9:
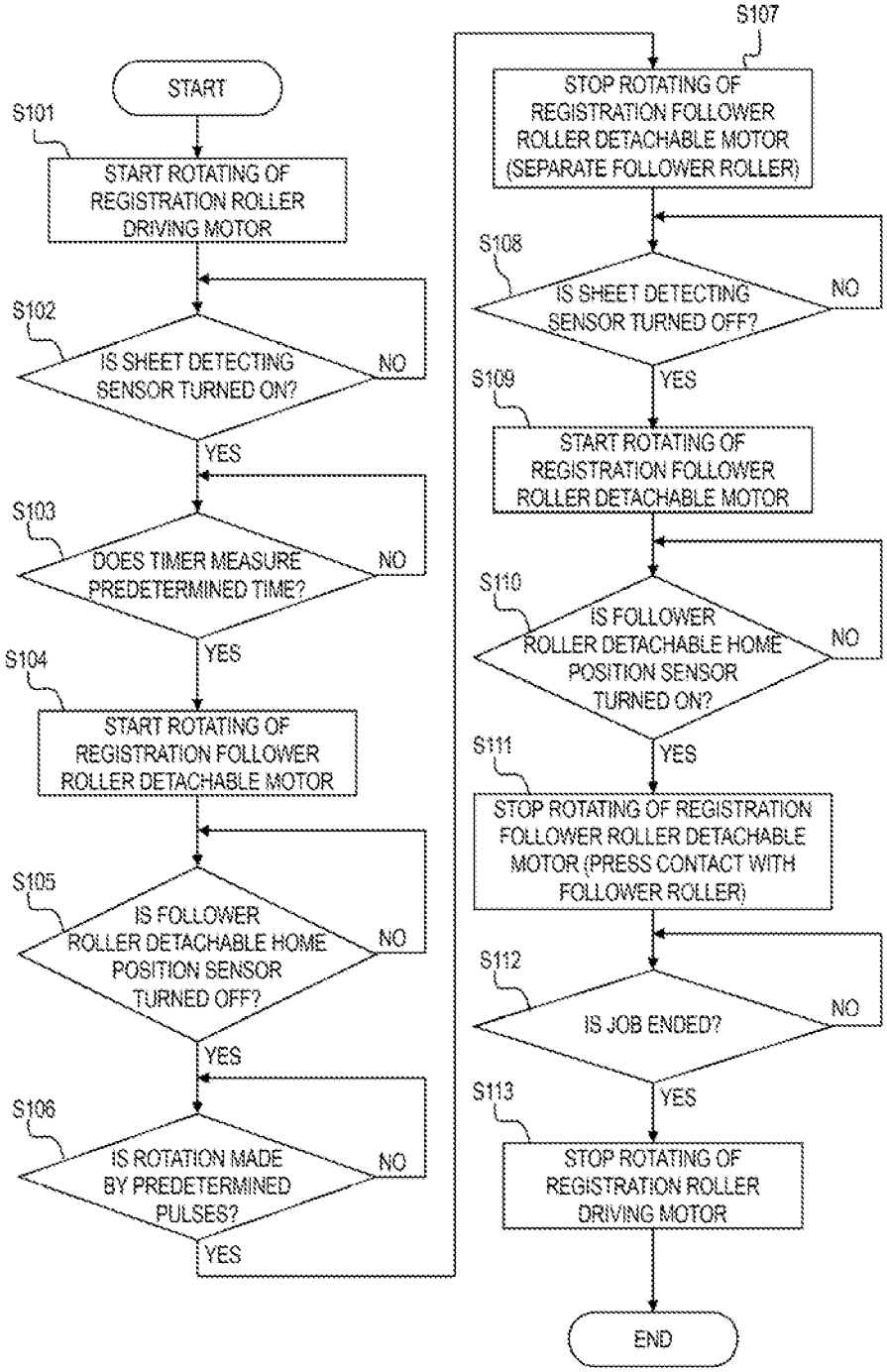
FIG. 9 is a flowchart illustrating control in which the contact/separation portion of the first embodiment causes the follower rotating member to come into contact with or be separated from the conveying rotating member.
Figure 10:
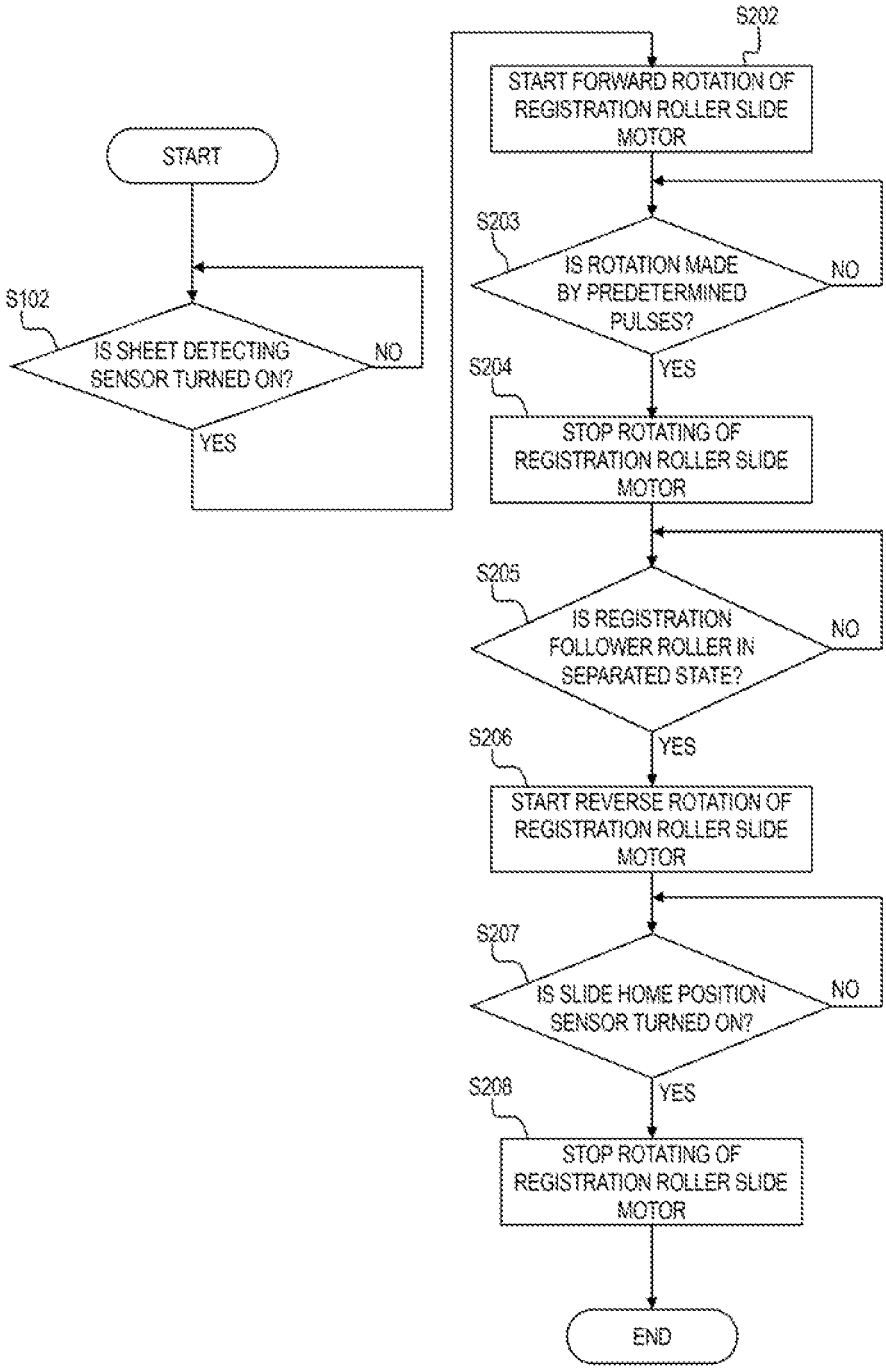
FIG. 10 is a flowchart illustrating control in which the slide portion of the first embodiment causes a pair of registration rollers (which includes the follower rotating member and the conveying rotating member) to move reciprocally in an axial direction.
Figure 11C:
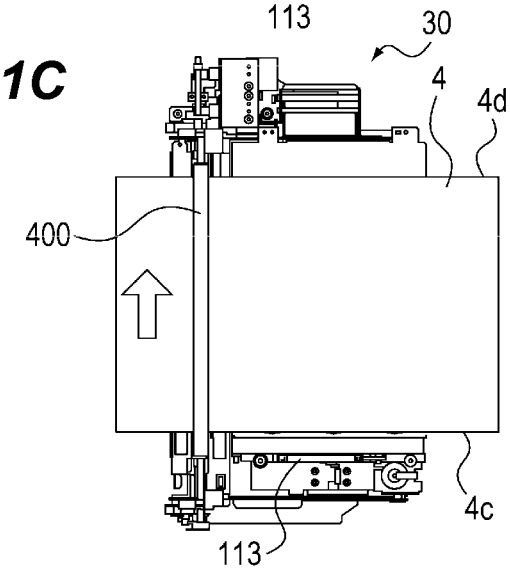
FIG. 11C is a plan view for describing behavior of a sheet in the registration unit of the first embodiment.

FIG. 9 is a flowchart illustrating control of the registration follower roller detachable motor 707. FIG. 10 is a flowchart illustrating control of the registration roller slide motor 601. Further, the controls illustrated in FIGS. 9 and 10 may be progressed at the same time, and thus in the following description the flowcharts illustrated in FIGS. 9 and 10 may be alternately described. FIGS. 11A to 11C are plan views for describing behaviors of the sheet 4 in the registration unit 30.

In the embodiment, as illustrated in FIG. 11C, the sheet 4 is conveyed on the basis of the center portion. As illustrated in FIG. 11A, when the sheet 4 is conveyed to the registration unit 30, the sheet 4 is positioned substantially in the center portion in the width direction. As illustrated in FIG. 11A, the abutting plate 113 of the skew-conveying roller guide portion 110 is previously moved by the skew-conveying guide moving portion 300 to a position making a gap of X mm from the side end portion 4*c* of the sheet 4 in the width direction according to a width of the sheet 4 on which a toner image is formed.

As illustrated in FIG. 11B, while being nipped between the skew-conveying roller 111 and the roller 112 and oblique feeding, the sheet 4 is pushed to the abutting plate 113, and conveyed while the side end portion 4*c* of the sheet 4 abuts on the abutting plate 113 and along thereto. Therefore, in a case where the sheet 4 is inserted to the registration unit 30 while oblique feeding, the skew feeding of the sheet 4 can be corrected by making the sheet come in slidable contact with the abutting plate 113 while being nipped between the skew-conveying roller 111 and the roller 112 and oblique feeding.

Next, the sheet 4 is arrived at the pair of registration rollers 400. In Step S101 of FIG. 9, the registration roller driving motor 501 starts to rotatably drive before the sheet 4 is arrived at the pair of registration rollers 400. Then, as illustrated in FIG. 11C, the leading end of the sheet 4 passes through the pair of registration rollers 400, and in Step S102 the sheet detecting sensor 411 detects the sheet 4.

In Step S103, an elapse time after the sheet detecting sensor 411 detects the sheet 4 is measured by a predetermined timer. Then, at a timing point when the measured time of the timer reaches a time obtained by dividing a separation distance from the sheet detecting sensor 411 on a sheet conveying path to the secondary transfer portion 43 by the conveying speed of the sheet 4, it is determined that the sheet 4 is arrived at the secondary transfer portion 43.

It is determined that the leading end of the sheet 4 is arrived at the secondary transfer portion 43 based on the measured time of the timer in Step S103. If so, in Step S104, the registration follower roller detachable motor 707 starts to rotate. Then, in Steps S105 to S107, the registration follower roller detachable motor 707 stops rotating after predetermined pulses elapse since the follower roller detachable home position sensor 709 is turned off. Therefore, the cam 705 illustrated in FIG. 5 rotates the pressure arm 701 to separate the registration follower roller 402 from the registration driving roller 401, so that the pressure of the pair of registration rollers 400 is released.

On the other hand, when the sheet detecting sensor 411 detects the sheet 4 in Step S102 of FIG. 10, the registration roller slide motor 601 starts a forward rotation in Step S202. Therefore, as illustrated in FIG. 11C, the pair of registration rollers 400 pushes the sheet 4 to the center portion in the width direction while nipping and conveying the sheet 4.

When the registration roller slide motor 601 rotates by predetermined pulses in the forward direction and the sheet 4 is arrived at the center portion in the width direction, the registration roller slide motor 601 stops rotating (Steps S203 and S204). Therefore, it is possible to perform accuracy positioning when the toner image is transferred onto the sheet 4 in the secondary transfer portion 43.

In Step S107 illustrated in FIG. 9, the registration follower roller detachable motor 707 stops rotating and the registration follower roller 402 enters a separated state (Step S205). Then, in Step S206 of FIG. 10, the registration roller slide motor 601 starts a reverse rotation, and the pair of registration rollers 400 is returned toward the home position illustrated in FIG. 11A.

Then, in Step S207, the slide home position sensor 606 detects that the pair of registration rollers 400 is returned toward the home position illustrated in FIG. 11A. Then, in Step S208, the registration roller slide motor 601 stops rotating, and control on the next sheet 4 is prepared.

Next, in Step S108 of FIG. 9, when the sheet 4 gets out of the sheet detecting sensor 411, the sheet detecting sensor 411 is turned off. At this timing, in Step S109, the registration follower roller detachable motor 707 starts rotating. Then, the pressure of the pressure arm 701 caused by the cam 705 illustrated in FIG. 5 is released, the registration follower roller 402 is pressed to the registration driving roller 401 by the tension force of the pressure spring 703, and the pair of registration rollers 400 is returned to the press contact state.

Next, in Step S110, when the follower roller detachable home position sensor 709 detects that the pair of registration rollers 400 returns to the press contact state, the registration follower roller detachable motor 707 stops rotating in Step S111. Then, when a job is ended, the registration roller driving motor 501 stops rotating (Steps S112 and S113).

To sum up the controls described in the flowcharts of FIGS. 9 and 10, first, the sheet 4 is nipped and conveyed by the skew-conveying roller 111 and the roller 112 and abuts on the abutting plate 113 as illustrated in FIGS. 11A to 11C, so that the skew feeding is corrected. Then, the sheet 4 is nipped and conveyed by the pair of registration rollers 400, and the leading end of the sheet 4 is detected by the sheet detecting sensor 411 (Step S102). When the sheet detecting sensor 411 detects the leading end of the sheet 4, the pair of registration rollers 400 nipping the sheet 4 slides in the width direction of the sheet 4 (Steps S202 to S204), and a position of the sheet 4 in the width direction is corrected as illustrated in FIG. 11C.

After the position of the sheet 4 in the width direction is corrected, when the sheet 4 which is nipped and conveyed by the pair of registration rollers 400 is arrived at the secondary transfer portion 43 (Step S103), the pair of registration rollers 400 is separated (Steps S104 to S107). Further, a timing point when the pair of registration rollers 400 is separated is a time after a predetermined time elapses since the leading end of the sheet 4 is detected by the sheet detecting sensor 411.

Then, the separated pair of registration rollers 400 returns to the press contact state until the next sheet 4 is conveyed (Steps S108 to S111). Further, the pair of registration rollers 400 sliding in the width direction of the sheet 4 returns to the home position in the center portion of the sheet 4 in the width direction until the next sheet 4 is conveyed (Steps S205 to S208).

<Configuration of Pair of Registration Rollers>

Next, the configuration of the pair of registration rollers 400 will be described using FIG. 12. FIG. 12 is a cross-sectional view for describing the configuration of the registration driving roller 401 and the registration follower roller 402 which form the pair of registration rollers 400. The registration follower roller 402 of the embodiment is formed by a hollow metal roller. Inner diameters D1 of both end portions of the registration follower roller 402 are set to be larger than an inner diameter D2 of the center portion.

The step portion 402*c* is provided in a boundary portion between the inner diameter D1 of the both end portions of the registration follower roller 402 and the inner diameter D2 of the center portion, and an outer ring 451*a* of the bearing member 451 serving as the bearing member abuts on the step portion 402*c* and fixed thereto.

The shaft member 450 is rotatably inserted through the inner peripheral surface of an inner ring 451*b* of the bearing member 451. The shaft member 450 is supported by the sliding bearing member 404 which rotatably supports the both end portions of the shaft member 450.

The slide friction coefficient of the sliding bearing member 404 is set to be higher that of the bearing member 451. Therefore, when the registration follower roller 402 comes in contact with the registration driving roller 401 and is rotatably driven, the shaft member 450 axially supported by the sliding bearing member 404 having a high slide friction coefficient does not rotate, but the bearing member 451 having a low slide friction coefficient serves as the bearing member.

The stopper 7 serving as a restraining portion which restrains the bearing member 451 from moving in the axial direction is provided on the shaft member 450 to be fixed on a portion near the outer side of the bearing member 451 in the axial direction. When the pair of registration rollers 400 slides in the axial direction by the registration roller slide portion 600 illustrated in FIG. 6, the registration follower roller 402, the bearing member 451, and the shaft member 450 slide integrally in the axial direction.

Figure 13:
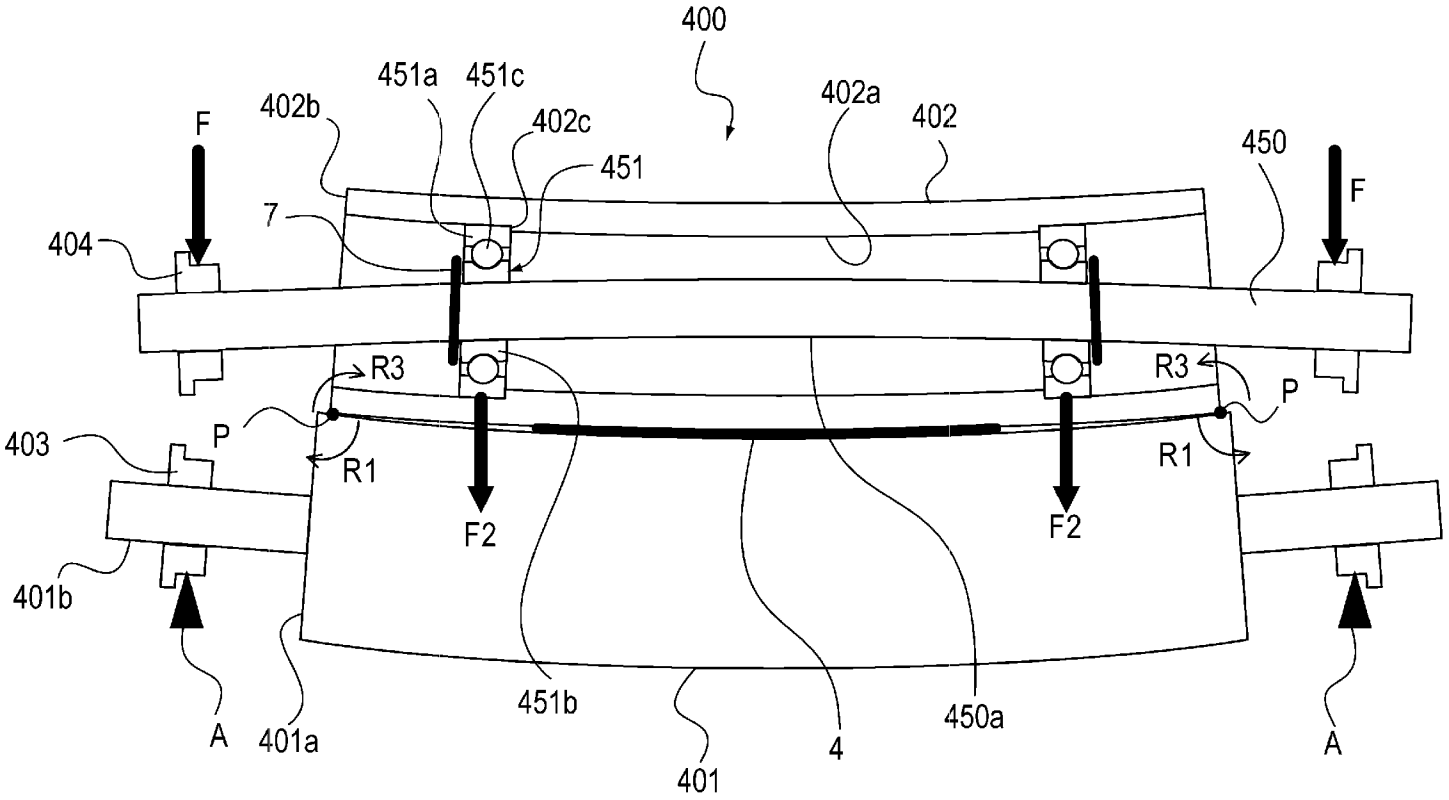
FIG. 13 is a cross-sectional view for describing a bending state of the pair of registration rollers which includes the follower rotating member and the conveying rotating member of the first embodiment.

FIG. 13 is a cross-sectional view for describing a bending state of the pair of registration rollers 400 when an urging force is applied to the shaft member 450 of the registration follower roller 402 through the pressure arm 701 by the tension force of the pressure spring 703 illustrated in FIG. 5. The urging force caused by the tension force of the pressure spring 703 is applied to the sliding bearing member 404 through the pressure arm 701 in a direction of arrow F of FIG. 13.

At this time, the bearing member 403 of the registration driving roller 401 is fixed to the apparatus frames 310 and 311 illustrated in FIGS. 2 and 6, and a fixing portion thereof serves as a fulcrum A with respect to the bending of the registration driving roller 401. The urging force caused by the tension force of the pressure spring 703 is also applied to the registration driving roller 401 with which the registration follower roller 402 comes in contact. Then, the registration driving roller 401 is forced by a rotational moment in a direction of arrow R1 of FIG. 13 about a point P and the center portion in the axial direction (the horizontal direction of FIG. 13) is convexly bent to the downward direction of FIG. 13.

On the other hand, in the registration follower roller 402, the urging force added in a direction of arrow F of FIG. 13 by the tension force of the pressure spring 703 is transferred from the sliding bearing member 404 which rotatably supports the shaft member 450 of the registration follower roller 402 through the pressure arm 701 toward the shaft member 450. Then, the urging force is exerted in a direction of arrow F2 of FIG. 13 through the inner ring 451*b* of the bearing member 451 which is fitted to the shaft member 450, a rolling body 451*c* such as a ball, and the outer ring 451*a*.

Therefore, the registration follower roller 402 is forced by the rotational moment in a direction of arrow R3 about the point P illustrated in FIG. 13 and the center portion in the axial direction (the horizontal direction of FIG. 13) similarly to the registration driving roller 401 is convexly bent to the downward direction of FIG. 13.

In the embodiment, as illustrated in FIG. 12, a length L2 of the registration follower roller 402 in the axial direction is configured to be shorter than a length L1 of the registration driving roller 401 in the axial direction. Therefore, as illustrated in FIG. 13, the registration driving roller 401 and the registration follower roller 402 are bent in the center portions thereof in the same direction (a direction of the center portion in the axial direction (the horizontal direction of FIG. 13) which protrudes to the lower side of FIG. 13) when being pressurized by the tension force of the pressure spring 703 serving as the pressure portion.

Further, the hollow registration follower roller 402 is rotatably supported by the shaft member 450, which passes through the hollow registration follower roller 402, through the bearing member 451 serving as the bearing member. In the embodiment, there is a clearance provided between the outer peripheral surface of the shaft member 450 and the inner peripheral surface of the inner ring 451*b* of the bearing member 451.

Further, there are clearances provided between the inner ring 451*b*, the rolling body 451*c*, and the outer ring 451*a* of the bearing member 451. Further, there is a clearance provided between an outer peripheral surface of the outer ring 451*a* of the bearing member 451 and the inner peripheral surface 402*a* of the hollow registration follower roller 402. With these multiplexing clearances, the bearing member 451 serving as the bearing member exerts a joint function as a mechanism having small clearances provided in a multiplexing manner, so that it is possible to allow the inclination of a shaft center caused by the bending the shaft member 450 serving as the support member as illustrated in FIG. 13.

Therefore, as illustrated in FIG. 13, the sheet 4 is reliably nipped by the registration driving roller 401 and the registration follower roller 402 regardless of whether the sheet 4 is thick or thin. Accordingly, there is no possibility to cause a conveyance fail for various types of the sheets 4.

In the embodiment, as illustrated in FIGS. 12 and 13, the bearing member 451 is disposed on a relatively inner side in the axial direction of the hollow registration follower roller 402. However, as long as the urging force exerted in a direction of arrow F2 through the bearing member 451 is on the inner side from the point P illustrated in FIG. 13 in the axial direction, the rotational moment in the direction of arrow R3 about the point P faces the same direction (a clockwise direction of FIG. 13) as the direction of arrow R3 illustrated in FIG. 13.

Figure 21:
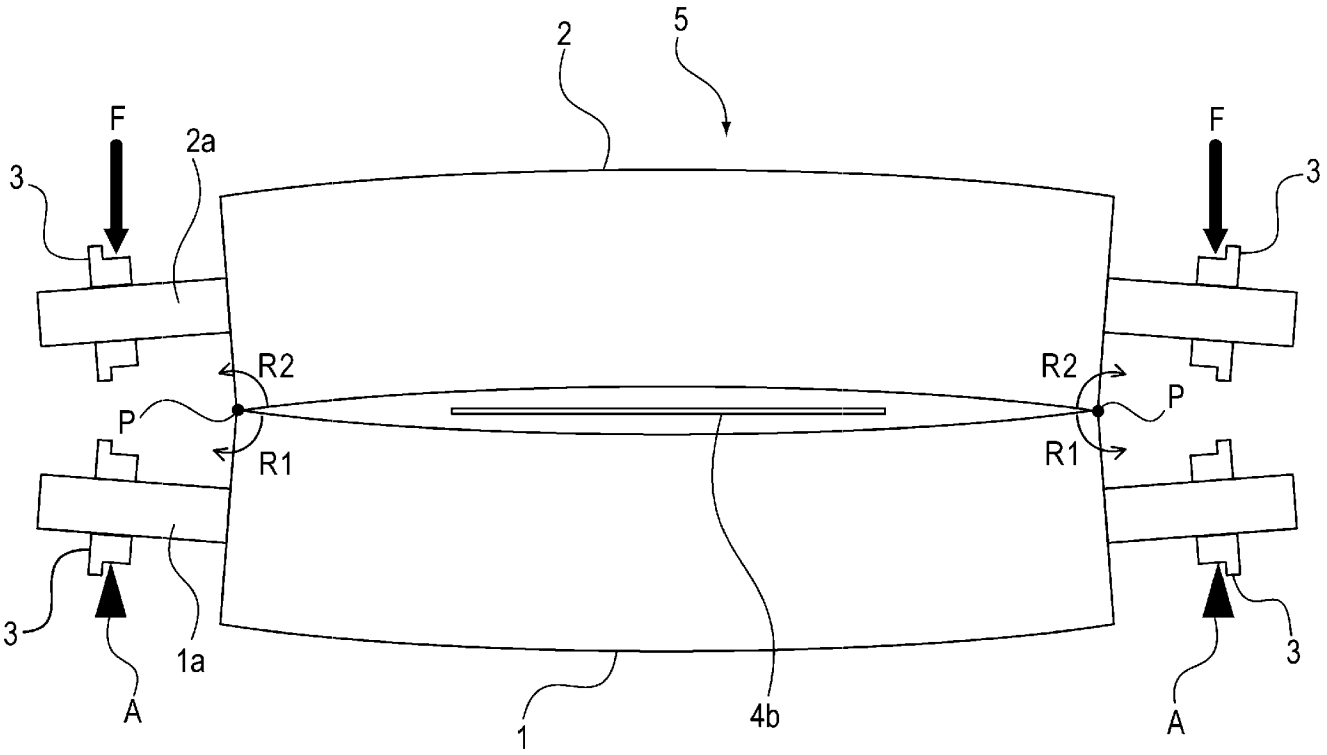
FIG. 21 is a cross-sectional view for describing the bending of the pair of registration rollers when a narrow and thin sheet is conveyed in the comparative example.

In a case where the registration follower roller 402 is not necessarily bent as much as the amount illustrated in FIG. 13, the bearing member 451 may be disposed on a portion near the end portion in the axial direction of the hollow registration follower roller 402. However, when the urging force exerted in a direction of arrow F2 through the bearing member 451 is on the outer side in the axial direction from the point P illustrated in FIG. 13, the rotational moment about the point P comes to be exerted in the same direction as a direction of arrow R2 of FIG. 21 similarly to a comparative example illustrated in FIG. 21. Therefore, the conveyance fail may be caused in a thin sheet 4 and a narrow sheet 4.

In the embodiment, since the bearing member 451 is interposed between the step portion 402*c* provided in a hollow inner wall surface and the stopper 7 fixed to the outer peripheral surface of the shaft member 450, the registration follower roller 402 is also provided with a clearance in the axial direction of the shaft member 450.

Therefore, the point P illustrated in FIG. 13 is reliably positioned on the inner side in the axial direction from the end portion of the registration driving roller 401 in the axial direction. Accordingly, as illustrated in FIG. 12, a relation between the length L1 of the registration driving roller 401 in the axial direction and the length L2 of the registration follower roller 402 in the axial direction is set as shown in the following Expression 1.

$$L1>L2 \qquad \text{[Expression 1]}$$

As illustrated in FIG. 13, in the registration follower roller 402, the urging force added to the sliding bearing member 404 in a direction of arrow F of FIG. 13 by the tension force of the pressure spring 703 is exerted in a direction of arrow F2 of FIG. 13 through the shaft member 450 and the bearing member 451. Therefore, the registration follower roller 402 is convexly bent to a downward direction of FIG. 13, and the shaft member 450 is convexly bent to an upward direction of FIG. 13.

In this way, when a deviation of the bending angle in a reverse direction is not allowed, noises may be generated or durability may be degraded. The bearing member 451 of the embodiment can absorb a slight inclination in the axial direction and allows a deviation of the bending angle in the reverse direction.

The bending angle is changed according to the urging force which is determined based on a thickness and width of the conveying sheet 4 and a required conveying force. Therefore, in a case where the deviation of the bending angle is not sufficiently allowed, the bearing member 451 may be used to prevent a severe backlash in a radial direction, or a self-aligning ball bearing having a large allowance range may be used for the bending angle.

Figure 14:
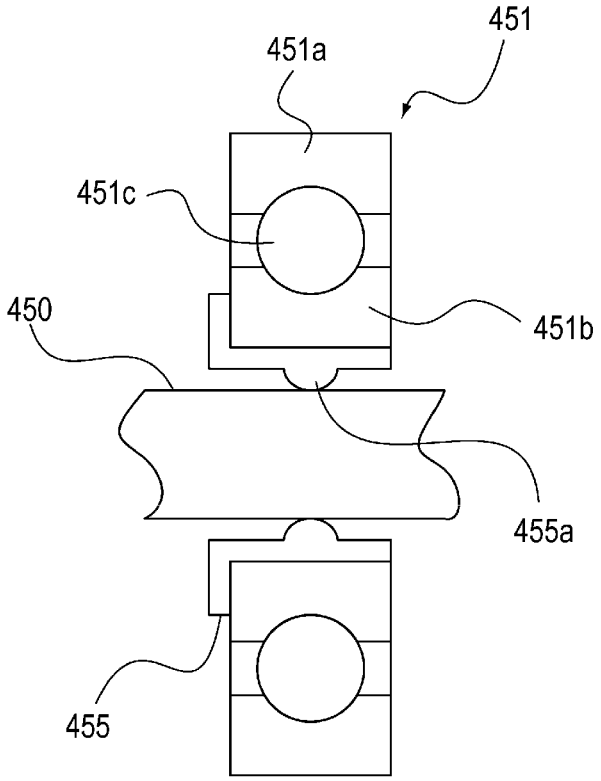
FIG. 14 is a cross-sectional view for describing another configuration of a bearing member.

Further, as illustrated in FIG. 14, the bearing 455 provided with a protrusion 455*a* in the center portion thereof is provided in the inner peripheral surface of the inner ring 451*b* of the bearing member 451, and the shaft member 450 is rotatably supported by the bearing 455. Therefore, even when an inclination is generated in the axial direction of the shaft member 450, the inclination of the shaft member 450 in the axial direction may be allowed by the protrusion 455*a* of the bearing 455.

As illustrated in FIG. 13, even when the bending of the registration follower roller 402 is allowed, it is effective in preventing the conveyance fail of the sheet 4. Therefore, it is possible to prevent the bending caused by a large diameter of the registration follower roller 402, and accordingly it is possible to suppress an increase in size of the apparatus caused by employing a high-powered and large-sized motor and a rise in cost.

Figure 15:
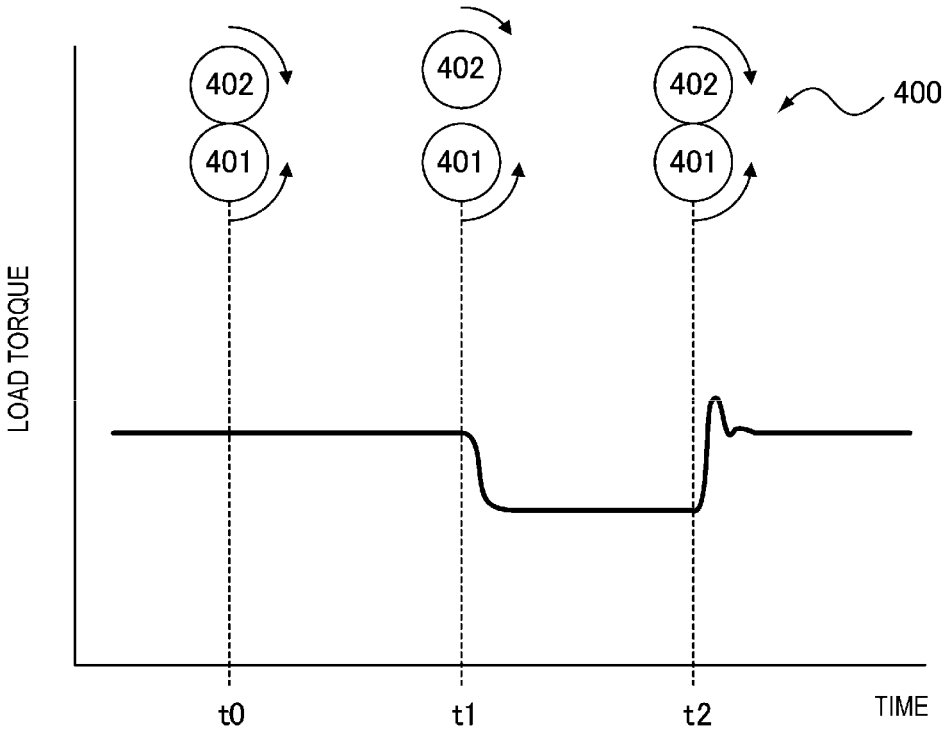
FIG. 15 is a diagram illustrating a change in load torque applied on a rotating shaft of the conveying rotating member of the pair of registration rollers which includes the follower rotating member and the conveying rotating member of the first embodiment.

FIG. 15 is a graph illustrating a time transition of load torque on the driving shaft of the registration roller driving motor 501. The hollow registration follower roller 402 of the embodiment is rotatably supported by the bearing member 451 having a low friction coefficient. Therefore, the registration roller driving motor 501 rotatably driving the registration driving roller 401 which comes in contact with the registration follower roller 402 to make the registration follower roller 402 rotatably driven is reduced in rotational resistance.

Figure 20:
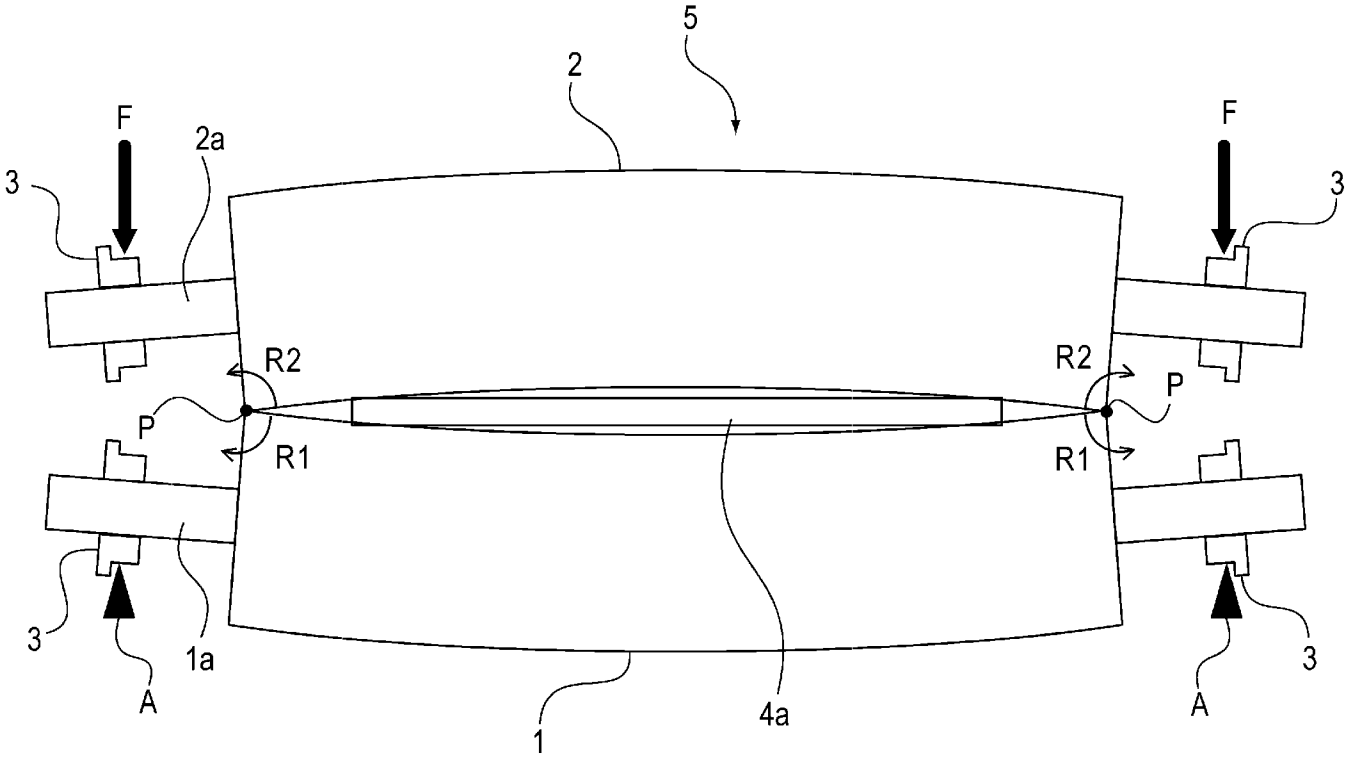
FIG. 20 is a cross-sectional view for describing the bending of the pair of registration rollers when a thick sheet is conveyed in a comparative example.
Figure 22:
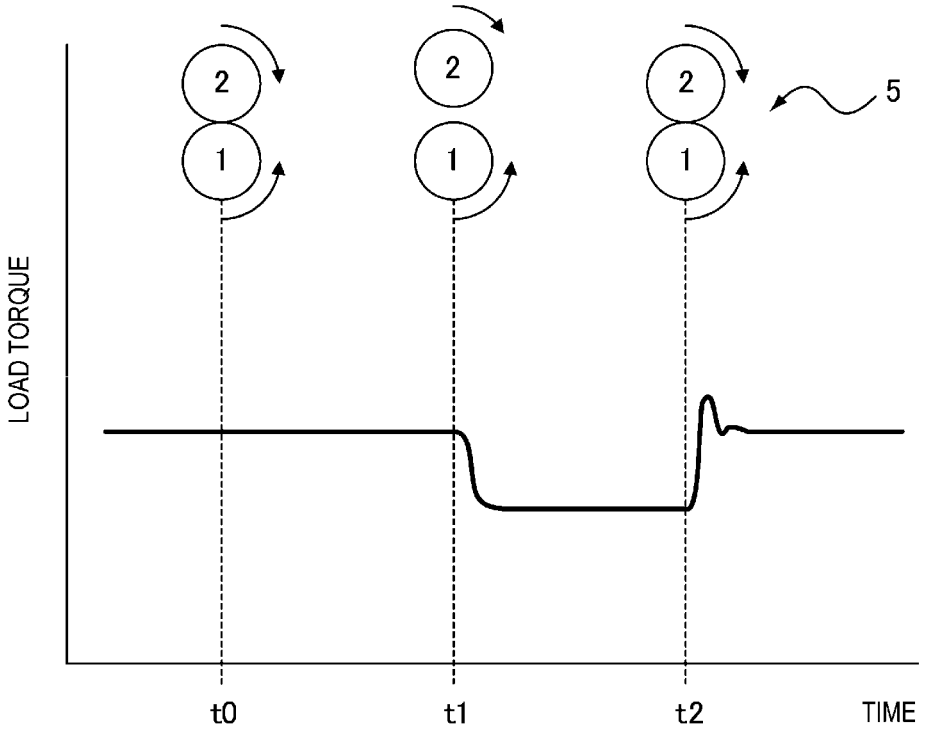
FIG. 22 is a diagram illustrating a change in load torque applied on the rotating shaft of the conveying rotating member of the pair of registration rollers which includes a follower rotating member and a conveying rotating member in the comparative example.

Therefore, as illustrated in FIG. 15, the load torque at time t0 in the pressurized state of the registration follower roller 402 is suppressed low compared to the comparative example illustrated in FIG. 22. FIG. 22 is a graph illustrating a time transition of the load torque applied on a rotating shaft 1*a* of the driving roller 1 in the comparative example showed in FIGS. 20 and 21. At a time when the follower roller 2 is separated from the driving roller 1 (time t1) rather than a time when the pair of registration rollers 5 rotates in press contact (time t0), the load torque applied on the rotating shaft 1*a* of the driving roller 1 is lowered. When the registration follower roller 402 is separated from the registration driving roller 401, the load torque falls (time t1). At this time, having a low rotational resistance, the registration follower roller 402 keeps rotating in inertia.

Next, the registration follower roller 402 is pressurized to the rotating registration driving roller 401 at time t2 again. At this time, the registration follower roller 402 still rotates. Further, the rotational resistance itself is lowered. Further, the inner portion of the registration follower roller 402 is formed in a hollow structure. Therefore, a synergy effect is obtained by lowering the inertia, and thus a load torque is not steeply increased compared to the comparative example illustrated in FIG. 22. Accordingly, even when a high-powered motor is not employed, it is possible to realize an increase in the conveying speed of the sheet 4 which contributes to a high productivity.

Further, the durability of the bearing member depends on a PV value (Urging force×Rotation speed). In the embodiment, the bearing member 451 which has a low slide friction coefficient and a high durability is used for the support with respect to the rotation of the registration follower roller 402. Further, the nonrotating shaft member 450 is supported by the sliding bearing member 404 having a high slide friction coefficient against the sliding operation of the registration follower roller 402 in the axial direction. In this way, the functions of the bearing member are separated according to the usage. Therefore, even when the conveying speed of the sheet 4 is increased, it is possible to achieve a long lifespan of the bearing member.

Second Embodiment

Next, a configuration of a second embodiment of the sheet conveying apparatus and the image forming apparatus which includes the sheet conveying apparatus according to the invention will be described using FIGS. 16 to 18. Further, the same components as those in the first embodiment will be denoted with the same reference numerals or the same member names even different reference numerals, and the descriptions thereof will not be repeated.

In the first embodiment, the case where the sheet conveying apparatus according to the invention is applied to the pair of registration rollers 400 has been described as an example. In the embodiment, a case where the sheet conveying apparatus according to the invention is applied to a pair of conveying rollers 9 which is provided in the sheet discharging portion 60 will be described as an example.

Figure 16:
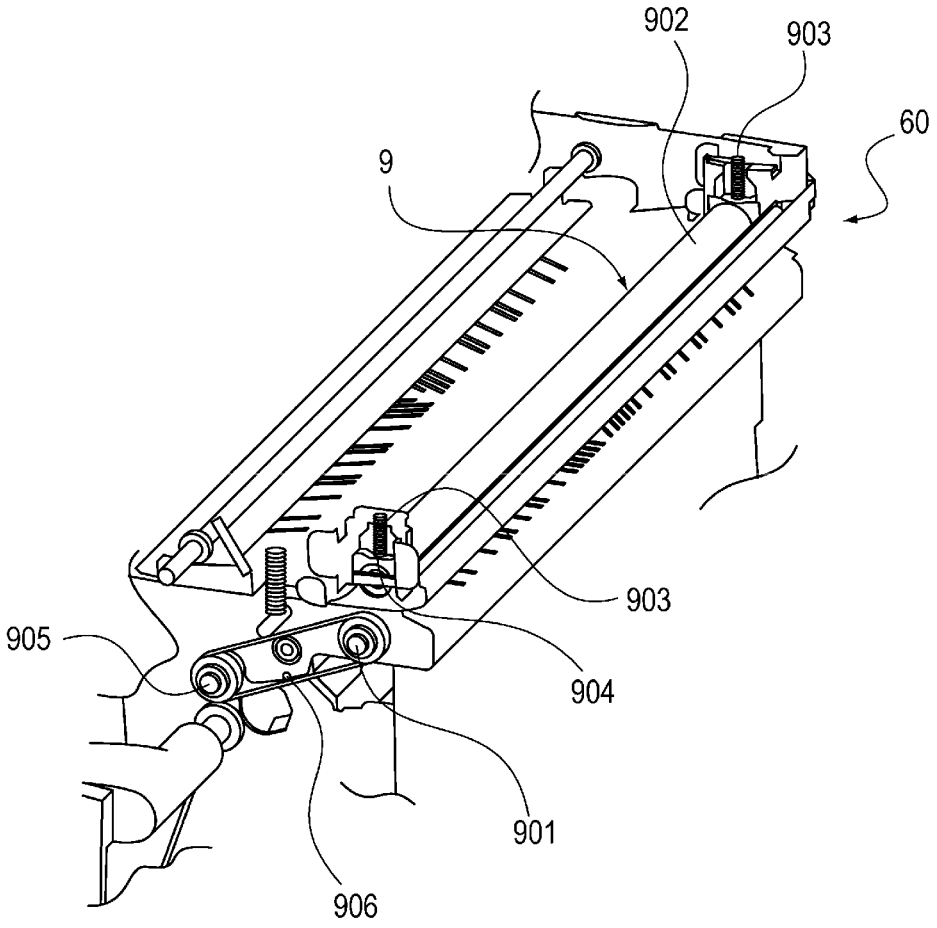
FIG. 16 is a perspective view for describing a configuration of a second embodiment of the sheet conveying apparatus according to the invention.
Figure 17:
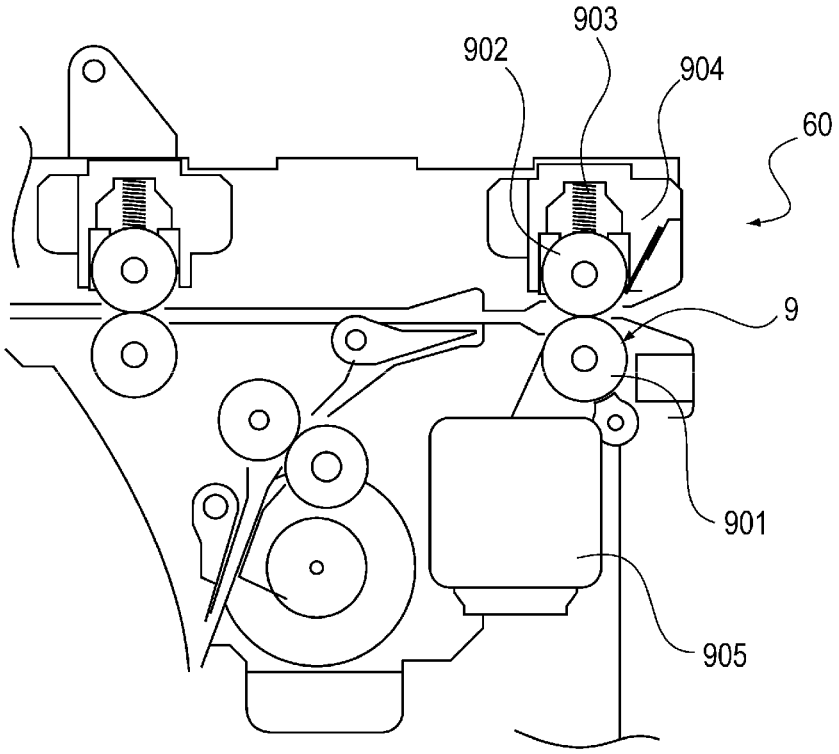
FIG. 17 is a cross-sectional view for describing a configuration of the second embodiment.

FIG. 16 is a perspective view for describing a configuration of the sheet discharging portion 60 serving as the sheet conveying apparatus of the embodiment. FIG. 17 is a cross-sectional view for describing a configuration of the sheet discharging portion 60 serving as the sheet conveying apparatus of the embodiment. As illustrated in FIG. 1, the toner image transferred on the sheet 4 is heated and pressurized by the fixing apparatus 50 and fixed on the sheet 4.

Immediately after the sheet 4 passes through the fixing apparatus 50 and the toner image is fixed thereon, the toner image is not completely fixed. In this state, when the sheet is nipped in the pair of conveying rollers 9 which is provided in the sheet discharging portion 60 in the axial direction, there may occur glossiness unevenness between a portion nipped in the pair of conveying rollers 9 and a portion not nipped in the pair of conveying rollers 9. As a countermeasure, the glossiness unevenness may be reduced using a cylindrical roller longer than the width of the sheet 4 in the axial direction.

Since all the pair of conveying rollers 9 provided in the sheet discharging portion 60 have the same shape, one pair of conveying rollers 9 will be described using FIG. 18.

Figure 18:
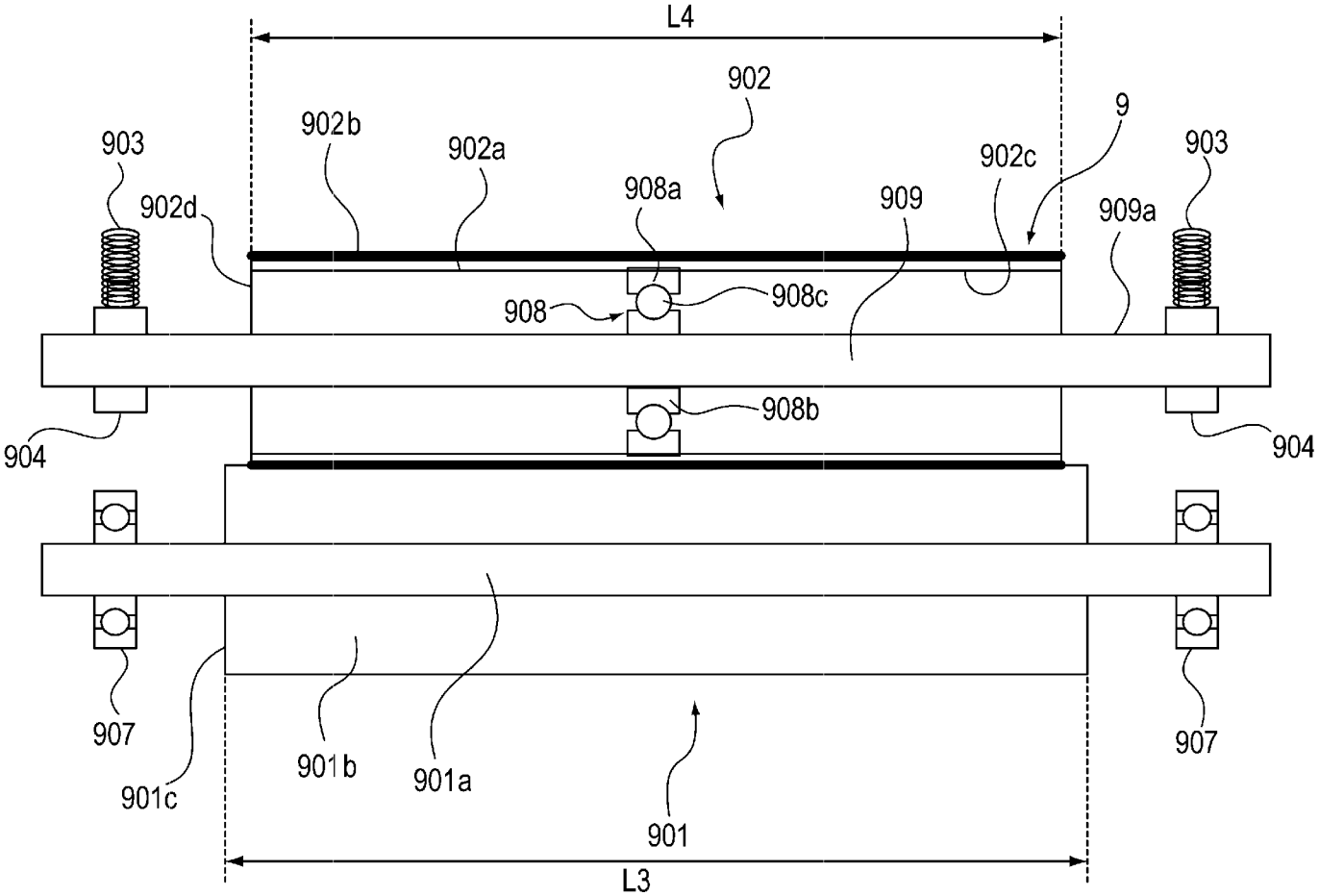
FIG. 18 is a cross-sectional view for describing a configuration of a pair of discharge rollers which includes a follower rotating member and a conveying rotating member of the second embodiment.

As illustrated in FIGS. 16 and 18, a discharge driving roller 901 is rotatably driven by a driving motor 905 serving as a driving portion through a timing belt 906. A discharge follower roller 902 serving as a cylindrical follower rotating member is rotatably provided to face the discharge driving roller 901 serving as a conveying rotating member which conveys the sheet 4.

In the embodiment, a length L4 of the discharge follower roller 902 in the axial direction is set to be shorter than a length L3 of the discharge driving roller 901 in the axial direction.

As illustrated in FIG. 18, a shaft member 909 serving as a support member is provided to pass through a hollow inner portion of the discharge follower roller 902. The discharge follower roller 902 is axially supported by the shaft member 909 to be freely rotated through a bearing member 908 serving as the bearing member.

The bearing member 908 is disposed to the center portion in the axial direction from an end portion 901*c* of the discharge driving roller 901 between an outer peripheral surface 909*a* of the shaft member 909 serving as the support member and an inner peripheral surface 902*c* of the discharge follower roller 902. The bearing member 908 supports the discharge follower roller 902 to freely rotate with respect to the shaft member 909.

In the outer portion of the discharge follower roller 902 in the shaft member 909, a pair of bearing members 904 is provided to axially support the shaft member 909 to be freely rotated. One end portion of a pressure spring 903 formed by a coil spring serving as a pressure portion is engaged with the apparatus frame, and the other end is engaged with a resin bearing member 904 serving as the second bearing member. The outer portion of the discharge follower roller 902 in the shaft member 909 is pressurized by a stretching force of the pressure spring 903 through the bearing member 904 toward the discharge driving roller 901.

The discharge driving roller 901 is configured such that a rubber roller portion 901*b* is coated on a metal rotating shaft 901*a*. Both end portions of the rotating shaft 901*a* are rotatably supported by a bearing member 907 serving as the bearing member which is provided in the apparatus frame.

The discharge follower roller 902 is configured such that a thermal contraction tube 902*b* having high toner parting properties is wound on the superficial surface of a thick metal hollow cylindrical roller 902*a* in order to prevent the toner from being attached to after a fixing operation. The bearing member 908 is disposed in the center portion of the discharge follower roller 902 in the axial direction.

An outer ring 908*a* of the bearing member 908 is fitted to the inner peripheral surface 902*c* of the hollow cylindrical roller 902*a*, and the inner ring 908*b* is fitted to the outer peripheral surface 909*a* of the shaft member 909.

A second bearing member 904 which rotatably supports the shaft member 909 serving as the support member is set to have a slide friction coefficient higher than that of the bearing member 908 serving as the bearing member. The second bearing member 904 is disposed on the outer side in the axial direction from an end portion 902*d* of the discharge follower roller 902.

In the embodiment, the slide friction coefficient of the bearing member 908 is lower than that of the bearing member 904. Therefore, the shaft member 909 does not rotate during the rotation of the discharge follower roller 902.

As illustrated in FIG. 18, since a ratio occupied by the rubber roller portion 901*b* is large and geometrical moment of inertia is small, the cross section of the discharge driving roller 901 is easily bent. Therefore, having a thin thickness, the metal hollow cylindrical roller 902*a* of the discharge follower roller 902 is configured to be easily bent.

Then, the center portion of the discharge follower roller 902 in the axial direction is pressurized in the downward direction of FIG. 18 by the bearing member 908 which is provided in the hollow inner portion of the discharge follower roller 902. Therefore, even when the discharge driving roller 901 is bent, the discharge follower roller 902 is also bent following the same direction as that of the discharge driving roller 901.

Figure 19:
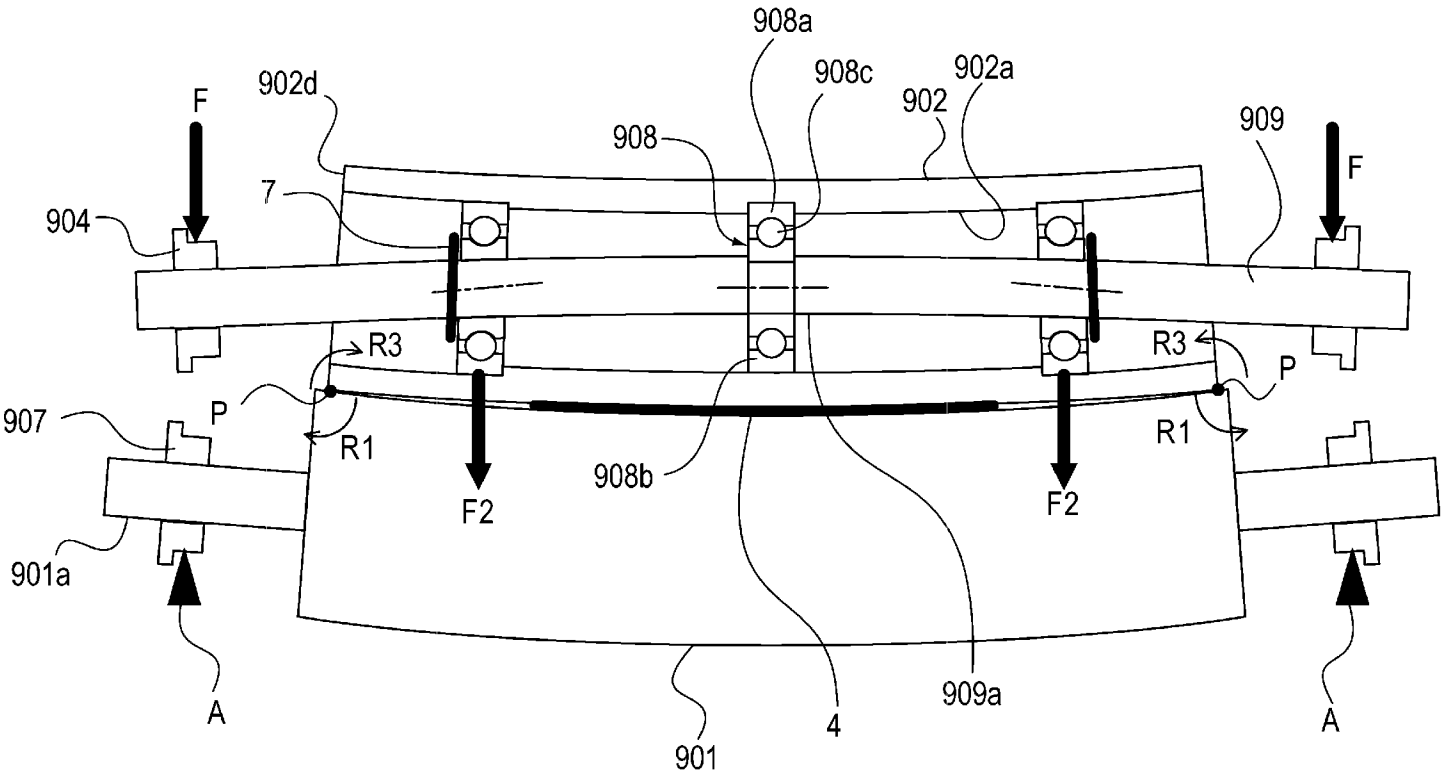
FIG. 19 is a cross-sectional view for describing a bending state of a pair of conveying rollers which includes the follower rotating member and the conveying rotating member of the second embodiment.

Further, according to the embodiment, as illustrated in FIG. 19, the bearing member 908 is disposed in the center portion of the shaft member 909 in the axial direction (the horizontal direction of FIG. 19). Therefore, the bending of the shaft member 909 causes a load on a portion having no inclination of the shaft center. Accordingly, it is possible to alleviate an influence caused by the restriction on a clearance between the shaft member 909 and the bearing member 908 and a clearance inside the bearing member 908.

In other words, the discharge driving roller 901 and the discharge follower roller 902 are bent in the same direction (the downward direction of FIG. 19) when being pressurized by the pressure spring 903. Therefore, similarly to the first embodiment, it is possible to stably convey various types of sheets 4, and the urging force on the sheet 4 in the width direction is relatively uniform, so that image defect such as glossiness unevenness can also be alleviated. The other configurations are the same as those of the first embodiment, and the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-215928, filed Oct. 17, 2013, which is hereby incorporated by reference herein in its entirety.

What is claimed is:

1. A sheet conveying apparatus comprising:

a conveying rotating member which is rotatably driven by a driving portion and conveys a sheet;

a cylindrical follower rotating member which is disposed to face the conveying rotating member;

a support member which passes through a hollow portion of the follower rotating member and supports the follower rotating member;

a pressure portion which biases the support member toward the conveying rotating member so that the follower rotating member comes into contact with the conveying rotating member;

a first bearing portion which is disposed between an outer peripheral surface of the support member and an inner peripheral surface of the follower rotating member and rotatably supports the follower rotating member with respect to the support member; and a second bearing portion which movably supports the support member and has a slide friction coefficient higher than that of the first bearing portion.

2. The sheet conveying apparatus according to claim 1, wherein when the support member is being biased by the pressure portion, the conveying rotating member and the follower rotating member are bent in the same direction.

3. The sheet conveying apparatus according to claim 1, wherein a length of the follower rotating member in the axial direction is shorter than a length of the conveying rotating member in the axial direction.

4. The sheet conveying apparatus according to claim 1, wherein the first bearing portion allows an inclination of a shaft center caused by bending of the support member.

5. The sheet conveying apparatus according to claim 1, further comprising:

a separation portion which enables the follower rotating member to be separated from the conveying rotating member; and a controller which causes the separation portion to operate during a period when the conveying rotating member rotates.

6. The sheet conveying apparatus according to claim 1, further comprising a slide portion which reciprocally moves the follower rotating member in the axial direction, wherein when the follower rotating member is moved by the slide portion in the axial direction, the second bearing portion and the support member come in sliding contact with each other.

7. The sheet conveying apparatus according to claim 1, further comprising a slide portion which reciprocally moves the follower rotating member in the axial direction.

8. The sheet conveying apparatus according to claim 1, wherein the first bearing portion includes an inner ring, an outer ring, and a rolling body disposed between the inner ring and the outer ring.

9. The sheet conveying apparatus according to claim 1, wherein the first bearing portion is disposed on an inner side in an axial direction of the support member from an end portion of the conveying rotating member and is disposed on an inner side in the axial direction of the support member from an end portion of the follower rotating member.

10. An image forming apparatus comprising:

the sheet conveying apparatus according to claim 1; and an image forming portion which forms an image in a sheet.

11. A sheet conveying apparatus comprising:

a conveying rotating member which is rotatably driven by a driving portion and conveys a sheet;

a cylindrical follower rotating member which is disposed to face the conveying rotating member;

a support member which passes through a hollow portion of the follower rotating member and supports the follower rotating member;

a pressure portion which biases the support member toward the conveying rotating member so that the follower rotating member comes into contact with the conveying rotating member;

a first bearing portion which is disposed between an outer peripheral surface of the support member and an inner peripheral surface of the follower rotating member and rotatably supports the follower rotating member with respect to the support member; and a second bearing portion which movably supports the support member, wherein a friction coefficient between the second bearing portion and the support member is set such that when a rotation force is transferred from the conveying rotating member to the follower rotating member, the follower rotating member is rotated with respect to the support member through the first bearing portion, and the support member is not rotated with respect to the second bearing portion.

12. A sheet conveying apparatus according to claim 11, wherein the first bearing member is disposed on an inner side in an axial direction of the support member from an end portion of the conveying rotating member and is disposed on an inner side in an axial direction of the support member from an end portion of the follower rotating member.

13. A sheet conveying apparatus according to claim 11, further comprising a sliding portion which is configured to move the follower rotating member forward and backward in a direction of the shaft.

14. A sheet conveying apparatus comprising:

a first rotating member which conveys a sheet;

a cylindrical second rotating member which is pressed to the first rotating member;

a shaft which is disposed inside the second rotating member and supports the second rotating member;

a first bearing portion which is provided between the shaft and the second rotating member and rotatably supports the second rotating member;

a moving portion which moves the first rotating member and the second rotating member in the axial direction;

a second bearing portion which bears the shaft to freely slide in the axial direction when the first rotating member and the second rotating member are moved by the moving portion in the axial direction, and a pressure portion which biases an outer portion of the shaft in the axial direction from the second rotating member such that the second rotating member is pressed to the first rotating member, wherein when the second rotating member rotates by being born with the first bearing member with respect to the shaft according to a rotation force received from the first rotating member, the second bearing portion is configured not to allow the shaft to rotate.

15. The sheet conveying apparatus according to claim 14, wherein the first bearing portion includes an inner ring, an outer ring, and a rolling body disposed between the inner ring and the outer ring.

16. The sheet conveying apparatus according to claim 14, wherein a friction coefficient between the second bearing portion and the shaft is set such that when a rotation force is transferred from the first rotating member to the second rotating member, the second rotating member is rotated by the first bearing portion with respect to the shaft, and the shaft is not rotated with respect to the second bearing portion.

17. The sheet conveying apparatus according to claim 14, wherein the first bearing portion is disposed on an inner side in a axial direction of the shaft from an end portion of the first rotating member and is disposed on an inner side in the axial direction of the shaft from an end portion of the second rotating member.

* * * * *